US006458520B2

(12) United States Patent
Ishikawa et al.

(10) Patent No.: US 6,458,520 B2
(45) **Date of Patent: *Oct. 1, 2002**

(54) COLOR IMAGE FORMATION METHOD

(75) Inventors: Takatoshi Ishikawa; Hideaki Nomura, both of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/123,418

(22) Filed: Jul. 28, 1998

(30) Foreign Application Priority Data

Aug. 5, 1997 (JP) ..... 9-210781

(51) Int. Cl.[7] ..... G03C 5/00

(52) U.S. Cl. ..... 430/434; 430/357; 430/372; 430/503; 430/359; 430/963

(58) Field of Search ..... 430/357, 372, 430/359, 503, 963, 434

(56) References Cited

U.S. PATENT DOCUMENTS 5,154,995 A * 10/1992 Kawai ..... 430/503
5,344,750 A * 9/1994 Fujimoto et al. ..... 430/434
5,801,813 A * 9/1998 Morimoto et al. ..... 355/27
5,840,470 A * 11/1998 Bohan et al. ..... 430/359
6,210,870 B1 * 4/2001 Brockler et al. ..... 430/503
6,265,144 B1 * 7/2001 Okuyama et al. ..... 430/569

FOREIGN PATENT DOCUMENTS

JP 9-269570 10/1997

* cited by examiner

*Primary Examiner*—Janet Baxter
*Assistant Examiner*—Amanda C. Walke
(74) *Attorney, Agent, or Firm*—Sughrue Mion, PLLC

(57) ABSTRACT

A color image formation method is disclosed, comprising developing a photographed silver halide color photographic light-sensitive material, photoelectrically reading the image information obtained to convert it into a digital image information, and taking out the digital image information to a printer, wherein the development processing is performed under the condition satisfying at least one of the following conditions (1) to (4):

(1) the color developing agent concentration in the color developer is from 0.02 to 0.2 mol/l;

(2) the bromide ion concentration in the color developer is from 0.015 to 0.1 mol/l;

(3) the color development time is from 45 seconds to 2 minutes; and (4) the color development temperature is from 40 to 55° C.

3 Claims, 10 Drawing Sheets

[FIG. 1]
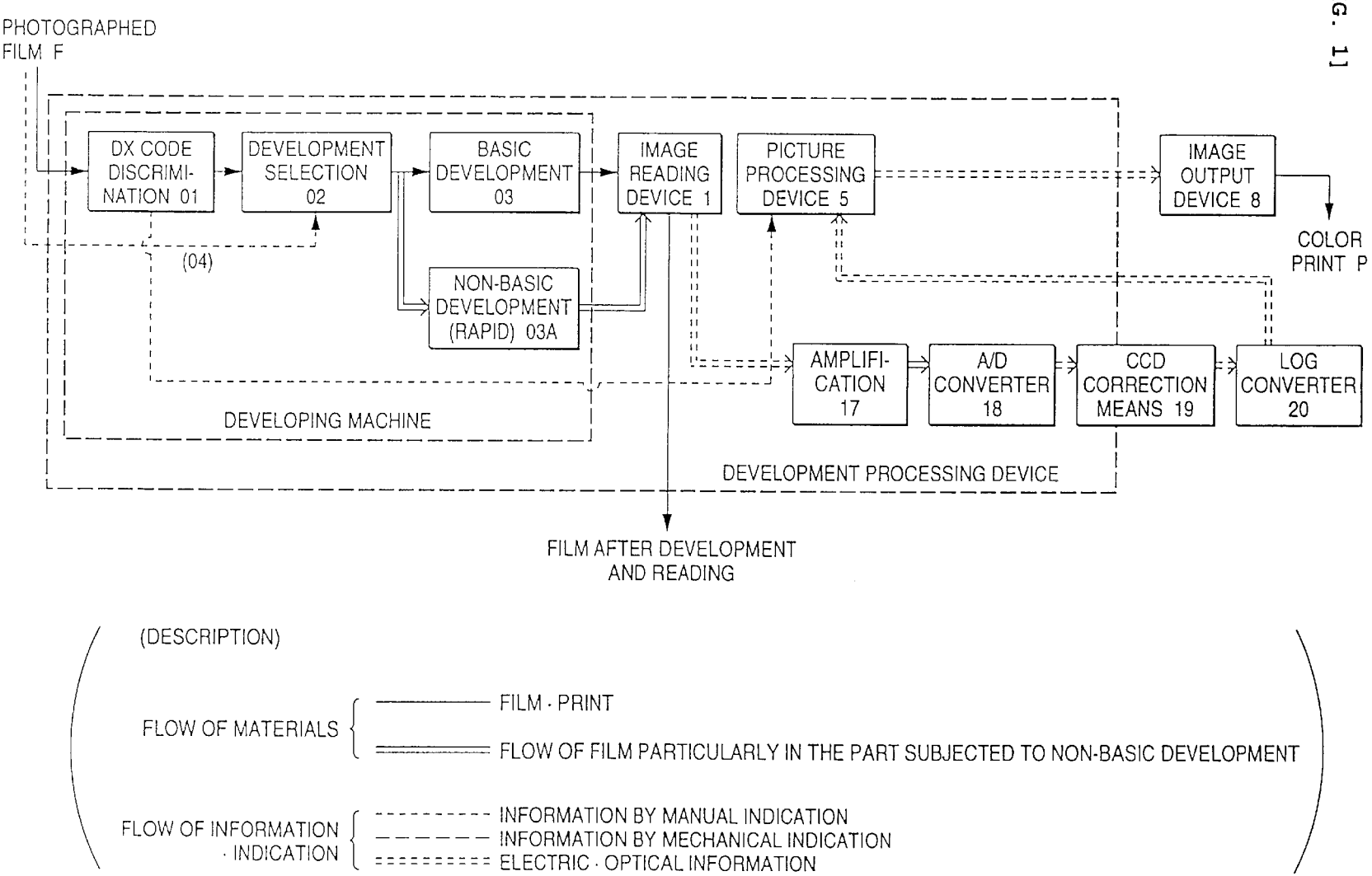

[FIG. 2]
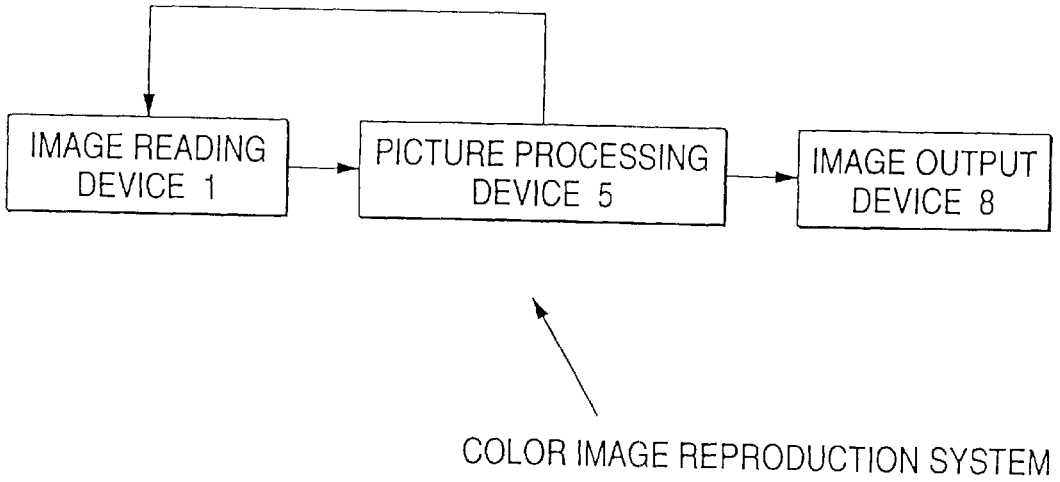

[FIG. 3]
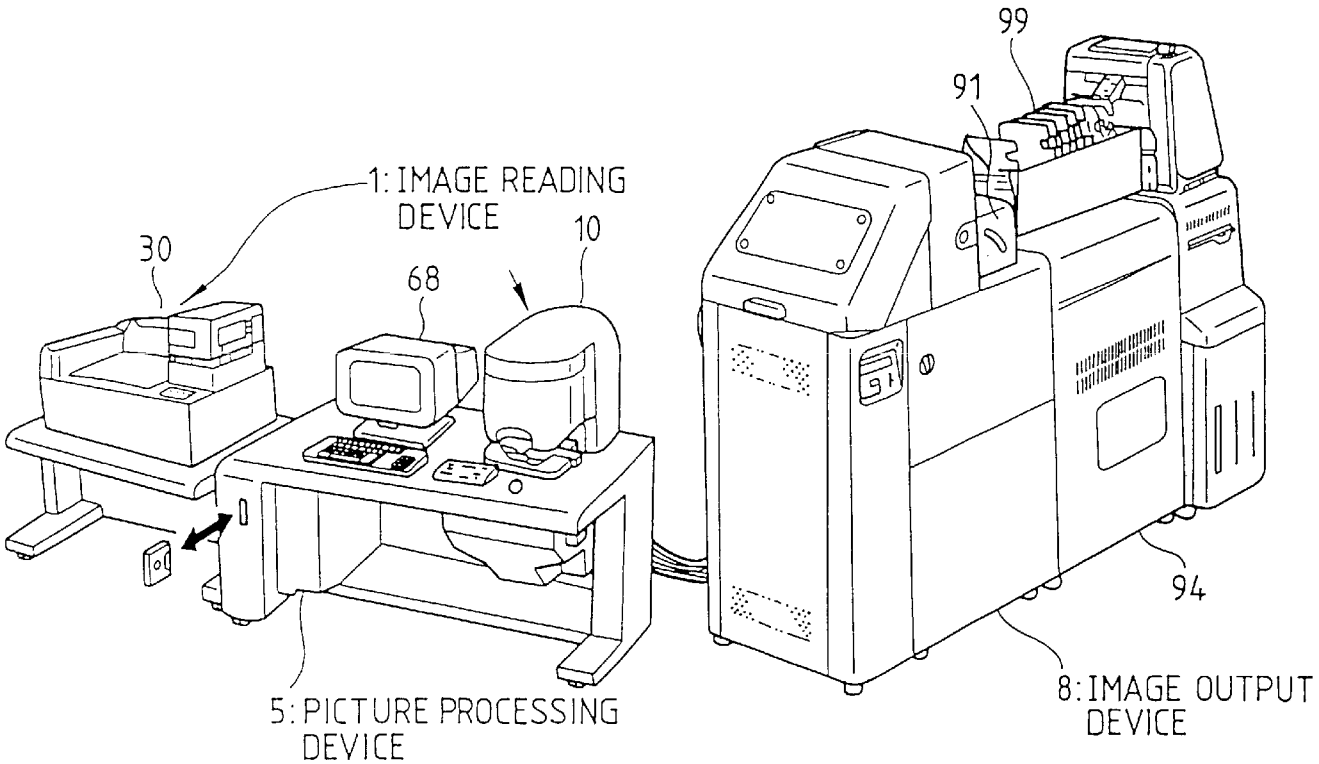

[FIG. 4]
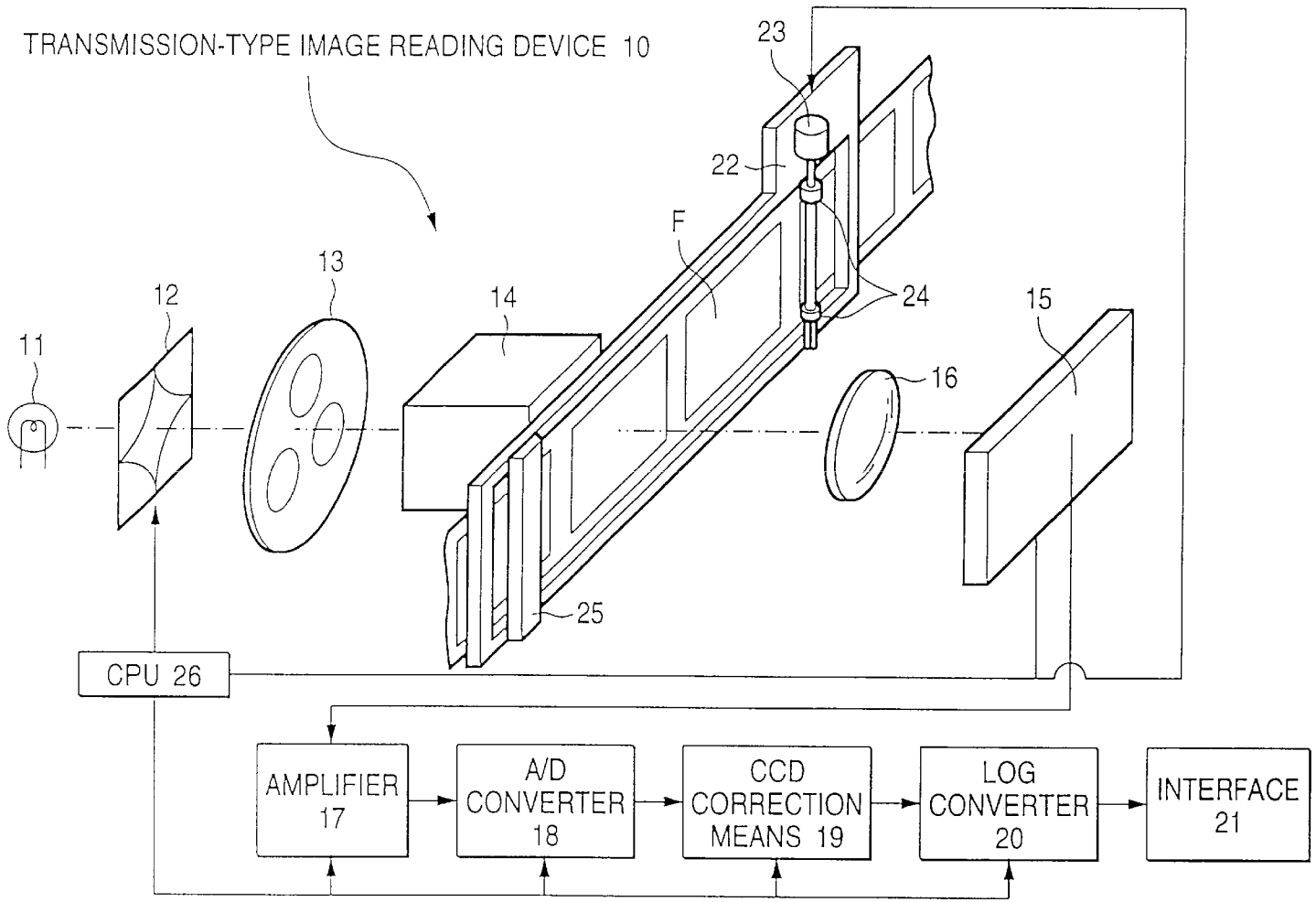

[FIG. 5]
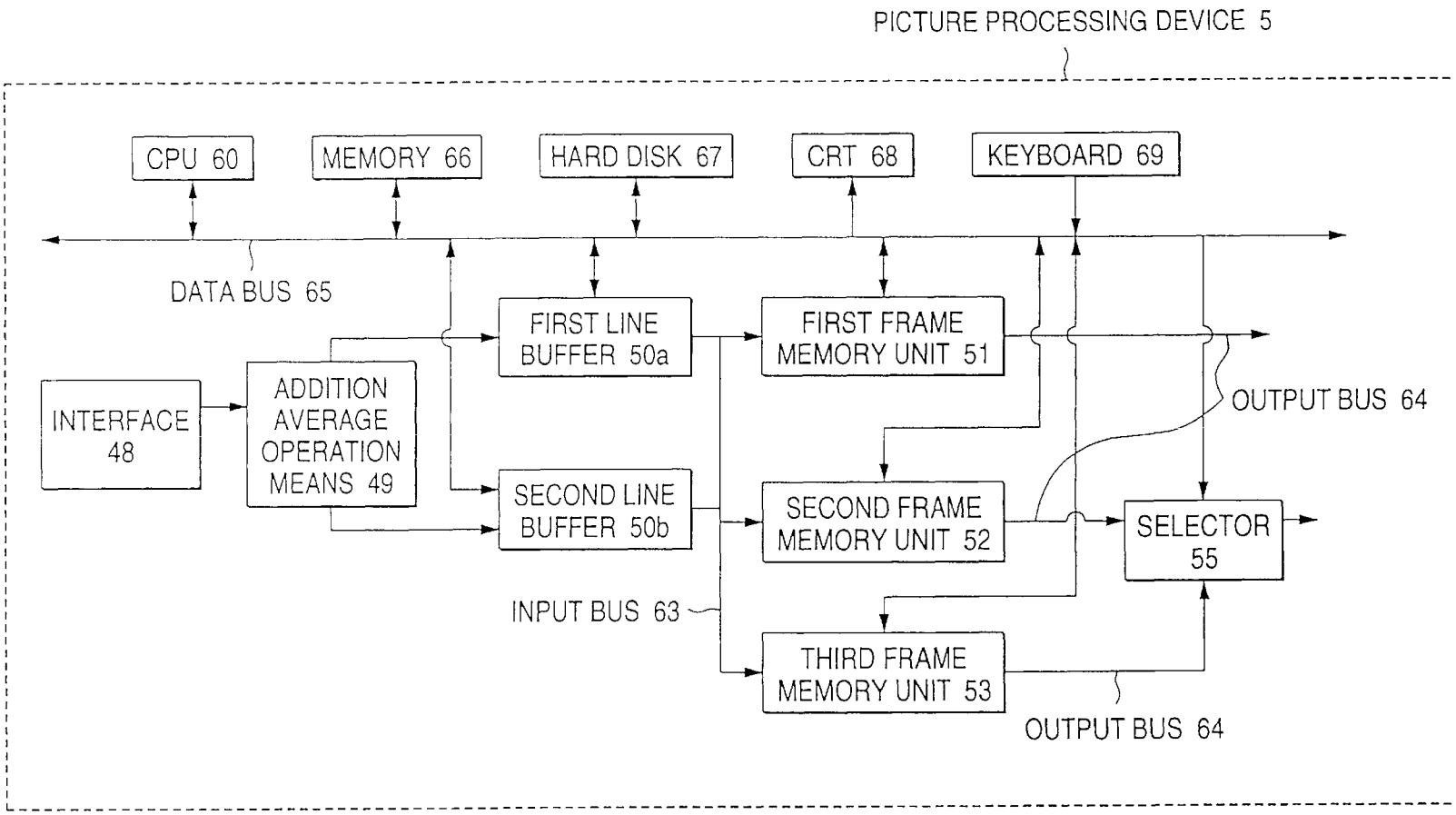

[FIG. 6]
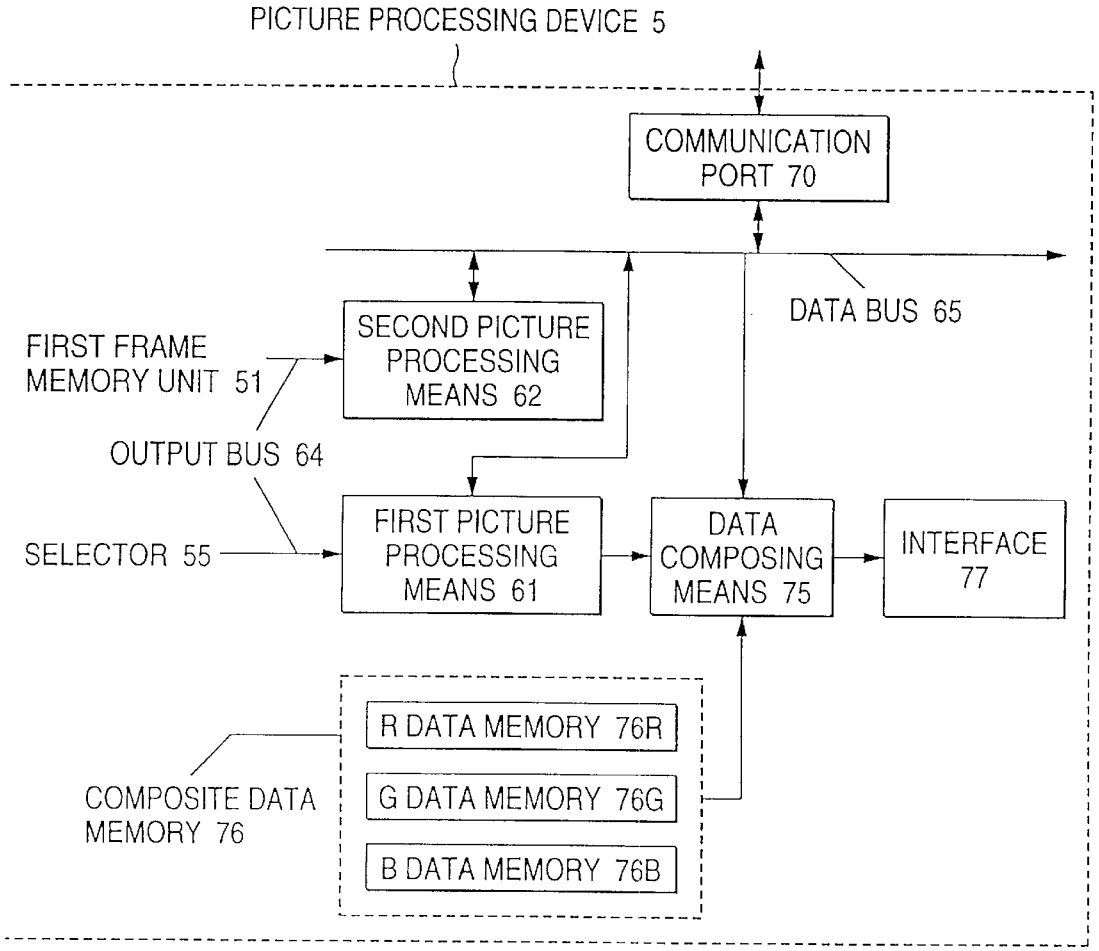

[FIG. 7]
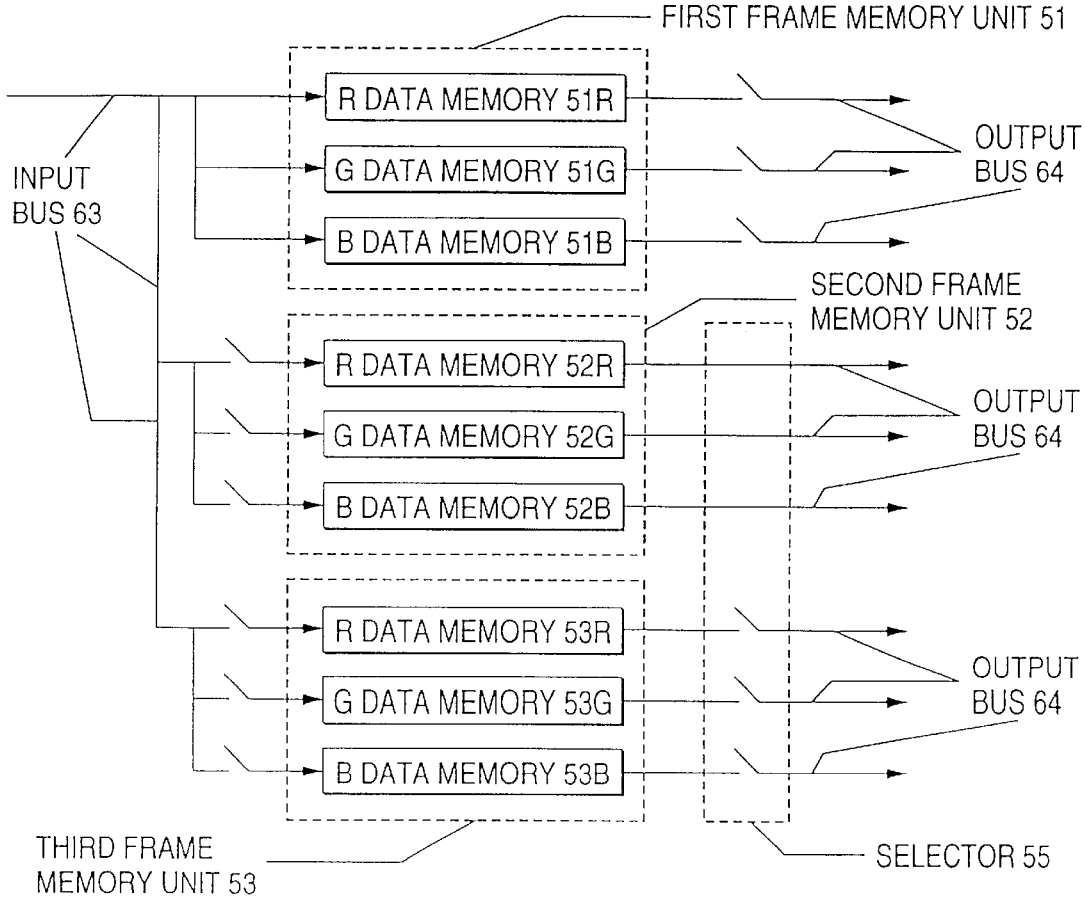

[FIG. 8]
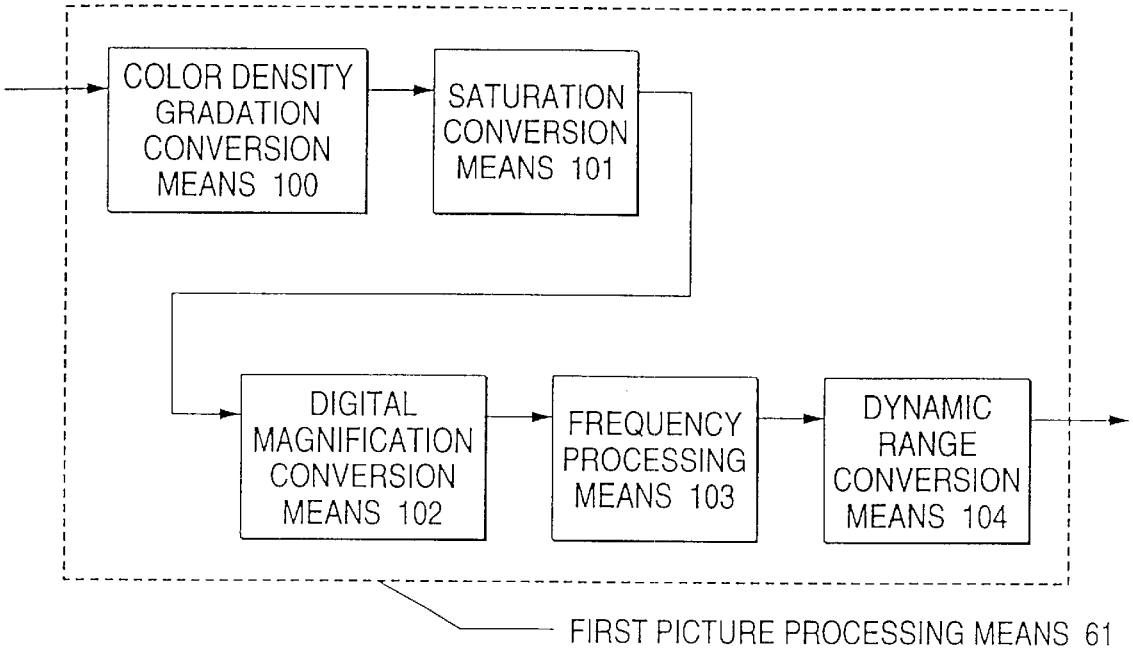

[FIG. 9]
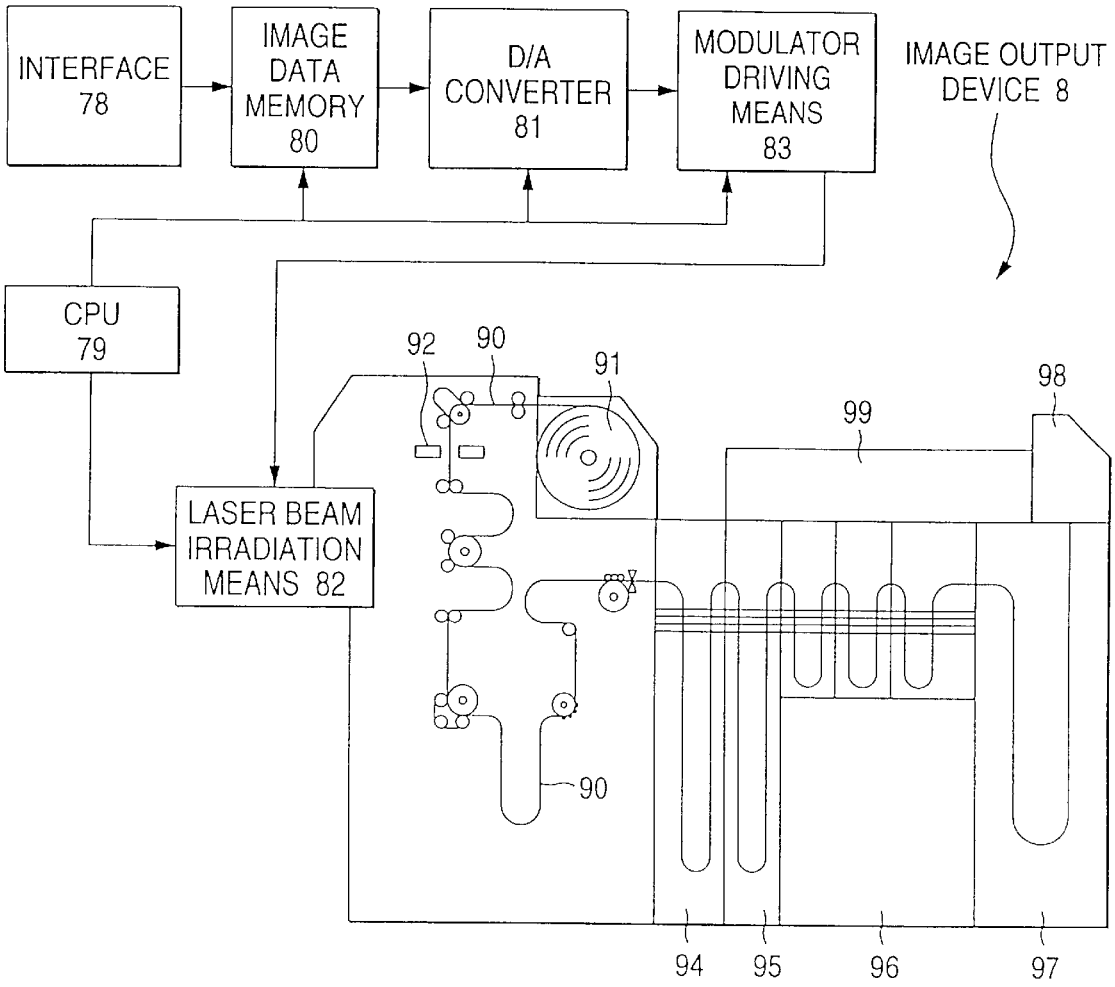

[FIG. 10]
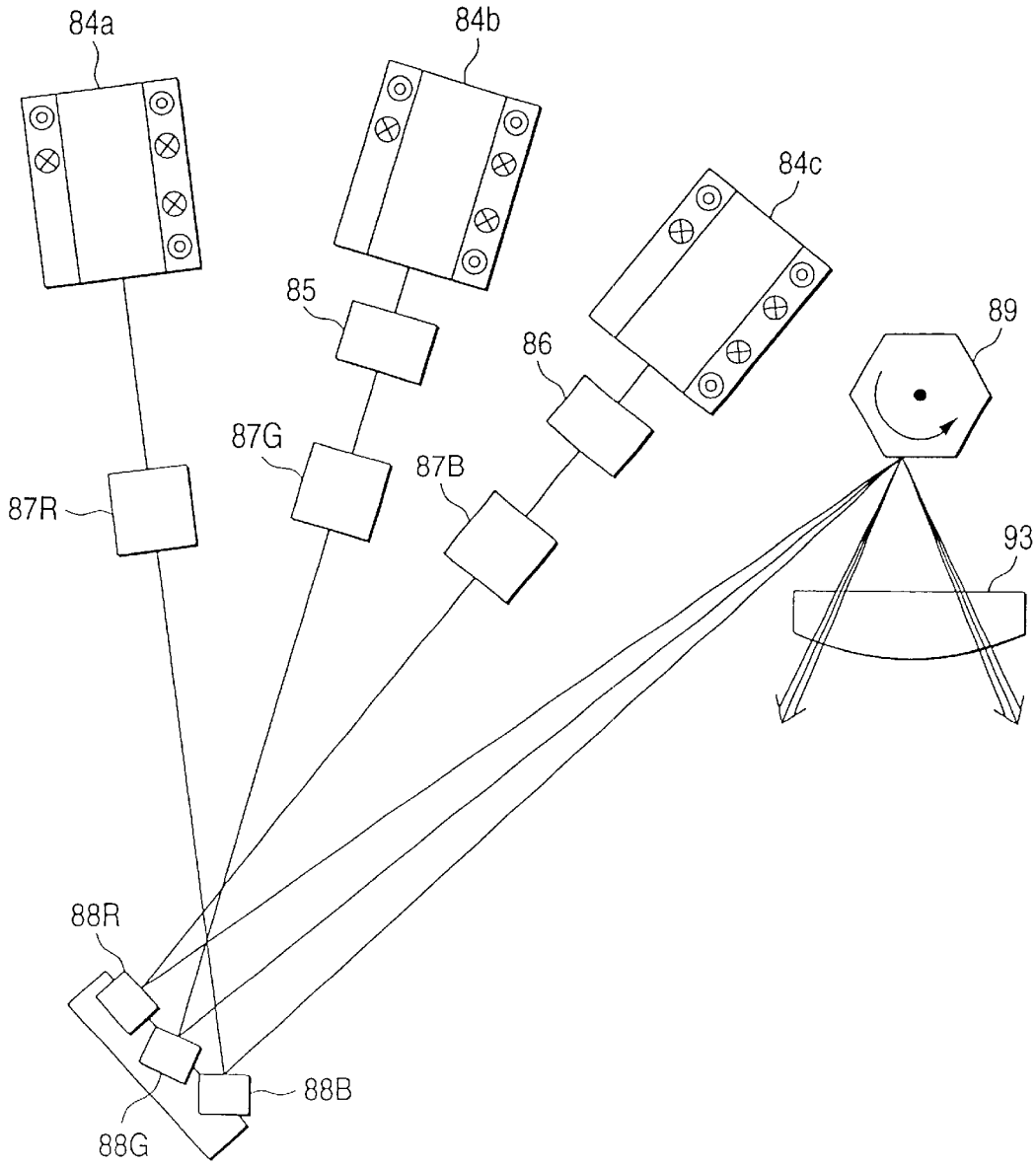

COLOR IMAGE FORMATION METHOD

FIELD OF THE INVENTION

The present invention relates to a color image formation method for obtaining a high-quality color print from a photographed silver halide color photographic light-sensitive material, more specifically, the present invention relates to a color image formation method capable of obtaining a high-quality color print having excellent graininess and sharpness.

BACKGROUND OF THE INVENTION

Color photographs most commonly used at present are formed by a so-called negative paper system (hereinafter referred to as "N/P system") where a photographed color negative film is developed at a processing laboratory and the image obtained on the film is printed on a printing paper to obtain a color print. This system has succeeded in coping with the popularization of color photographs and riding on the trend toward high-sensitivity color negative film and established the position as a substantially international common processing system. Accordingly, the development and print service network is perfected and the system can afford services of easy availability to users.

At present, color negative film products having various grades of sensitivity are being supplied and almost all purposes of various camera works can be satisfied with respect to the sensitivity required. Accordingly, improvement of the image quality is now being demanded rather than the sensitivity. The image quality is decided by a large number of factors such as graininess, sharpness, gradation and color tone and of these, the graininess and sharpness are important factors for the image quality. The sensitivity and the graininess are well known to be in a contradictory relationship to each other and if one is improved, the other is deteriorated. Hitherto, importance has been laid on the achievement of high sensitivity, however, the high-sensitivity color negative film products are already fully equipped and now, demands for improvement particularly in the graininess are increasing.

With the same sensitivity, the graininess and the sharpness contradict each other and improvements thereof can hardly be achieved at the same time.

However, the graininess and the sharpness both are important factors of the image quality and improvement in one part at the sacrifice of the other part is not allowed. Accordingly, in the current NP system of obtaining a print by printing an image on a paper from a developed negative film through non-scanning area-wise exposure, optimized conditions for both the graininess and the sharpness are designed.

In recent years, a system of obtaining a digital image information from an image on a developed film and making a print therefrom has been introduced. In this system, picture processing operations for elevating the sharpness can be used, such as an operation unit for stressing the edge part of the digitized electrical image and an operation unit for selectively intensifying the contrast at the foot part (highlight portion of a print). The operation for achieving stressed edge or locally intensified contrast some or less adversely affects the graininess, and improvement in both the graininess and the sharpness cannot be realized.

Also in the case where improvement of the graininess or sharpness is attempted to achieve by the development processing, the above-described contradictory relationship between these two factors is present, and techniques capable of improving both the graininess and the sharpness have not yet been found. Worse than all, when the graininess or sharpness is improved, photographic properties such as gradation, color balance, sensitivity and staining are changed in many cases and the image quality is impaired. The above-described current NP system processing optimized in the graininess and sharpness is also optimized with respect to other photographic properties and change from this processing condition is difficult because graininess, sharpness and other properties are impaired.

Thus, despite the strong demand for elevating the total image quality by improving both the sharpness and the graininess, this has not yet been realized at present.

SUMMARY OF THE INVENTION

Under these circumstances in the conventional background art and to meet the requirements on the market, the object of the present invention is to provide a color image formation method which can achieve improvements in both the graininess and the sharpness without impairing other image quality factors and can ensure a totally improved image quality at the time of developing a color photographic light-sensitive material for camera work and obtaining therefrom a positive image such as a color print.

As a result of extensive investigations, the present inventors have found that a specific combination of the development processing with the picture processing can attain the object of the present invention, namely, the improvements in both the graininess and the sharpness which are in a contradictory relation to each other and hitherto cannot be improved at the same time. More specifically, the present inventors have found that when the development processing and the picture processing are combined on a certain condition, improvement in the sharpness by the picture processing is not accompanied by deterioration of the graininess and at the same time, changes which usually occur in using a specific development processing condition for improving the graininess, such as reduction in the sharpness, reduction in the development sensitivity and collapse of the gradation and the color balance, are not caused. The present invention has been accomplished based on this finding. The present invention is as follows.

1. A color image formation method comprising developing a photographed silver halide color photographic light-sensitive material, photoelectrically reading the image information obtained to convert it into a digital image information, and taking out the digital image information to a printer, wherein the development processing is performed under the condition satisfying at least one of the following conditions (1) to (4):

(1) the color developing agent concentration in the color developer is from 0.02 to 0.2 mol/l;

(2) the bromide ion concentration in the color developer is from 0.015 to 0.1 mol/l;

(3) the color development time is from 45 seconds to 2 minutes; and (4) the color development temperature is from 40 to 55° C.; and 2. The color image formation method as described in 1 above, wherein the photographed silver halide color photographic light-sensitive material is a color negative film.

3. The color image formation method as described in 1 above, wherein said development processing is performed under the condition satisfying the conditions (1) and (2), simultaneously.

4. The color image formation method as described in 1 above, wherein said development processing is performed under the condition satisfying the conditions (1), (2) and (3), simultaneously.

5. The color image formation method as described in 1 above, wherein said development processing is performed under the condition satisfying the conditions (1), (2), (3) and (4), simultaneously.

6. The color image formation method as described in 1 above, wherein said color developing agent concentration in the color developer is from 0.025 to 0.1 mol/l.

7. The color image formation method as described in 1 above, wherein said bromide ion concentration in the color developer is from 0.02 to 0.05 mol/l.

8. The color image formation method as described in 1 above, wherein said color development temperature is from 42 to 50° C.

9. The color image formation method as described in 1 above, wherein a line CCD or an area CCD is used for photo-electrically reading the image information to convert it into a digital image information.

BRIEF DESCRIPTION OF THE DRAWINGS

FIG. 1 is a block diagram showing the fundamental construction and entire flow of the image formation method and apparatus therefor according to the present invention;

FIG. 2 is a block diagram showing the fundamental construction of the image reproduction system according to the present invention;

FIG. 3 is a view showing the appearance of the image reproduction system according to one embodiment of the present invention;

FIG. 4 is a view showing the outline of the transmission-type image reading device;

FIG. 5 is a block diagram showing one part of the construction of the picture processing device 5 shown in FIG. 2;

FIG. 6 is a block diagram showing the part not shown in FIG. 5, of the construction of the picture processing device 5 shown in FIG. 2;

FIG. 7 is a block diagram showing the details of the first frame memory unit, second frame memory unit and third frame memory unit shown in FIG. 5;

FIG. 8 is a block diagram showing the details of the first picture processing means shown in FIG. 6;

FIG. 9 is a view showing the outline of the image output device shown in FIG. 2; and FIG. 10 is a view showing the laser beam irradiation means of the image output device shown in FIG. 9.

DETAILED DESCRIPTION OF THE INVENTION

The embodiment of the present invention is described in detail below, however, the fundamental feature of the present invention resides in the skill of combining the image formation method with the finding that at the time of developing a photographed silver halide color photographic light-sensitive material to obtain a positive image, a condition which cancels the contradictory relationship hitherto considered to be present between the graininess and the sharpness of the image obtained, is presented by combining a specific development processing and the picture processing.

This specific development processing of a silver halide color photographic light-sensitive material is characterized in that the development processing is performed under the condition satisfying at least one of the following conditions (1) to (4):

(1) the color developing agent concentration in the color developer is from 0.02 to 0.2 mol/l;

(2) the bromide ion concentration in the color developer is from 0.015 to 0.1 mol/l;

(3) the color development time is from 45 seconds to 2 minutes; and (4) the color development temperature is from 40 to 55° C.

The conditions (1) to (4) are described below.

Condition (1):

The standard concentration of the developing agent for developing a color negative film is from 0.012 to 0.018 mol/l, predominantly 0.015 mol/l. In other words, this concentration level is optimal in the current NP system using the non-scanning area-wise exposure method. In the present invention, the concentration level is elevated to from 0.02 to 0.2 mol/l to improve the graininess. Such a high concentration is a technique generally incapable of being used because although the graininess is improved, the gradation is contrasted, the linearity becomes poor and the color balance among respective light-sensitive layers is lost. However, in the present invention using a combination with the picture processing, the above-described defects in the photographic properties do not come out on the final print. With respect to the standard developing agent concentration referred to above, the standard development as used herein is described later.

Condition (2):

The standard bromide ion concentration for developing a color negative film is from 0.010 to 0.014 mol/l, predominantly 0.012 mol/l. This concentration is the optimal range in the current NP system using the non-scanning area-wise exposure method. In the present invention, this concentration level is elevated to from 0.015 to 0.1 mol/l to improve the graininess. Such a high bromide ion concentration cannot be used in general because although the graininess is improved, due to retardation of the development progress, reduction in the sensitivity and soft contrast are caused, particularly, due to the retardation of the development progress on the surface layer, the color balance is lost. However, in the present invention using a combination with the picture processing, the above-described defects in the photographic properties do not come out on the final print.

Condition (3):

This condition is the color development condition reduced in the development time. The standard development processing conditions are 38° C. and 3 minutes and 15 seconds, and the temperature and time are controlled in an automatic developing machine with the allowance of ±0.2° C. and ±5 seconds. In the present invention, the processing time is reduced to from 45 to 120 seconds. Accordingly, unless the developing formulation is changed, deficient development naturally results to cause soft contrast and low sensitivity. In particular, the development progress of the red-sensitive layer is retarded to cause bad color balance in the highlight. However, in the method of the present invention using a combination with the picture processing, this appendant deterioration in the photographic properties can be compensated, and the sharpness and the graininess can be improved. When this condition is satisfied together with the condition (1) or (4) as described later, the appendant defects are more successfully overcome.

Condition (4):

This condition is the color development condition increased in the development temperature. The standard condition is 38° C. and 3 minutes and 15 seconds. In the present invention, the development temperature is elevated to from 40 to 55° C. and therefore, although the graininess is improved, the progress of development on the surface layer is accelerated to cause conspicuous collapse in the color balance and nonlinearity (torsion) in the gradation, of which effect, however, does not appear on the finished print obtained by using a combination with the picture processing.

As described above, these four processing conditions all cannot be used as it is for the manufacturing of a color print by the conventional non-scanning area-wise exposure method because although the graininess is improved, other photographic properties are deteriorated.

However, surprisingly, when the development processing is performed using one of the above-described four conditions or two or more thereof in combination and then the image on the film is subjected to the picture processing, deterioration in the photographic properties accompanying the development processing does not come out on the image signal after the picture processing but the improvement effect on the graininess due to the development processing and the improvement effect on the sharpness due to the picture processing are brought out, thus, the object of the present invention can be achieved.

By using the above-described four conditions in combination, subsidiary disadvantageous actions are further reduced and the action to improve the graininess and the sharpness, namely to attain the object of the present invention, becomes more aggressive. Particularly great effects can be obtained by the high-activity high-control processing using both (1) the increased developing agent concentration and (2) the increased bromide ion concentration, the high-temperature rapid processing using a combination of (3) reduced development time and (4) elevated development temperature, and the high-activity, high-control, high-temperature rapid processing using all of these four conditions. In the case of combining these conditions, the addition concentration, the temperature and the time each has the same preferred range as the range in the case of using respective conditions individually.

The standard development processing referred to above in the description of the effect of the present invention indicates the substantially common processing generally used in almost all processing laboratories over the world. More specifically, development processing formulations called CN16 series (Fuji Photo Film Co., Ltd.) or C41 series (Eastman Kodak Company) are the standard processing for the color negative film. These formulations called differently are substantially the same and most commonly used. On the other hand, at a processing laboratory, the standard processing is usually performed so that standard photographic capabilities can be exerted. The processing performed based on the standard of the laboratory is called as a basic processing from the standpoint of the laboratory and sometimes differentiated from the above-described international standard processing though these are substantially the same. Also in this specification, the terms "basic development" and "basic photographic properties" may be used for referring to the matters within the processing laboratory but these have the meanings as described above.

The processing temperature and the processing time at the color development step, and the color developing agent concentration and the bromide ion concentration of the color developer in the international common standard processing are the values as described above as standard conditions and the allowance fluctuation level employed at respective processing laboratories also fall within the aforementioned range as long as the normal operation is performed.

In the present invention, the term "development processing" means the full processing starting from the development step and finished by the drying step. When the "development" step is particularly indicated, the term "development" is used.

In the following description, the term "processing" commonly used in the "development processing" and "picture processing" means two operations quite different from each other and when there is a fear to incur confusion, the operations are referred to as the "development processing" and the "picture processing" respectively to distinguish these operations.

The image formation method of the present invention can be applied to a photographed silver halide color photographic light-sensitive material and in particular, when the method is applied to a color negative film, the characteristic behaviors in the above-described development processing conditions are more advantageously brought out and the effect of the present invention is great. The effect of the invention is still more remarkable when the method is introduced into the current NP system and used. The color negative film which can be processed includes any commercially available color negative film irrespective of the ISO sensitivity, standard size or packaging form. Further, the film which can be processed is not limited to the general-purpose color negative film, but color negative film for movie or for business cameraman may also be processed. The color negative film to which the present invention is applied is further described later.

The development processing apparatus to which the color image formation method of the present invention is applied may be any of those using roller transportation system, cine-type roller rack transportation system, hanging development system or processing solution coating development system, as long as the apparatus can be combined with the picture processing apparatus and a positive image can be taken out. The method can be used either at a large scale laboratory or at a mini-laboratory. The image formation method of the present invention is preferably applied to a roller transportation-type mini-laboratory development processing apparatus.

The present invention is described in detail below. FIG. 1 is a block diagram showing the development processing apparatus to which the present invention can be applied and the flow of operations in the apparatus. This Figure shows an example of an apparatus where the above-described standard processing (basic processing) and additionally the processing of the present invention (non-basic processing) can be performed. A film enters the development processing apparatus at the left edge of this diagram and the kind of the film is read (01). This reading is done to know the kind of the film marked with the punched signal called DX code for identification. Based on this "kind", the set conditions for the picture processing which will be described later are selected and selection (02) is also made whether the basic processing is performed or the high developing agent concentration processing, high bromide ion concentration processing or high-temperature rapid processing of the present invention is performed. This selection can also be made by an operator (04). A dedicated processing machine dispensed with selection of the development may also be used.

After the selection of the development condition, the film is transported to pass through a series of processing tanks in the developing machine. Many developing machines use a roller transportation system. A dedicated machine for the aforementioned basic processing commonly used almost all over the world or a machine capable of the basic processing and other one level or more rapid processings may be used. FIG. 3 shows an apparatus having both a basic processing step (03) and a non-basic processing step (rapid processing) (03A). The development processing step (03) comprises a soaking processing step consisting of color development, bleaching, fixing and water washing or stabilization, and a drying step subsequent thereto. After completion of the development, the film is transferred to an image reproduction step.

The image production step is divided into three steps of image information reading (block 1 in FIG. 1 and FIG. 2), picture processing (block 5 in FIG. 1 and FIG. 2) and reproduced image output (block 8 in FIG. 1 and FIG. 2).

In the image information reading step (1), the transmission density (or reflection density) per small area unit (usually called picture element) constituting the image on the developed film is measured and the image information is read as the density per picture element. As a result of the reading, the image information is converted into electrical image signals by the density values and then converted into a digital signal at the A/D (analog/digital) conversion part 18 through an amplification device 17. This information signal is subjected to correction 19 of the CCD function, such as correction of the sensitivity distribution among picture elements or the dark current, and then transferred to a picture processing device 5 through a log converter 20.

In the picture processing device, the image information converted to a digital signal is electrically processed and converted into a digital image signal which must have been obtained when the basic processing is performed. In the case where the film is processed by the basic development, this picture processing has a meaning merely that the distribution in the photographing condition, the development processing or the film characteristics is corrected and adjusted to a statistical central value. This is an important processing but not an objective of the present invention. When a rapid processing is selected, the developed film is in a slightly deficient development state and accordingly, the photographic characteristic values such as contrast, image area density, color balance or Dmin (density value on the unexposed area) are deviated from the values at the basic development. In the present invention, these deviations are corrected by the picture processing. This is a characteristic feature of the present invention. The above-described picture processing operation is performed by the method and arithmetic unit described in JP-A-10-20457 and JP-A-9-146247 (the term "JP-A" as used herein means an "unexamined published Japanese patent application").

After the correction to normal photographic characteristic values to be obtained by the basic development, the image signal of the processed film of the present invention is taken out to a printer (8) and then, a normal positive image can be obtained. The printer may be any printer as long as an electrical image signal or photoelectric image signal can be taken in, however, the printer is particularly preferably a printer for forming a positive image such as color print, instant photograph, silver salt color print such as dye heat transfer type, ink jet print, sublimation heat transfer print, wax-type heat transfer print, and color electrophotography.

In the foregoing, described is the outline of the apparatus and method of the present invention for obtaining a normal positive image as obtained by the basic processing, from a photographic image having not normal photographic characteristics on a film after rapid processing.

These are described in greater detail below.

In the present invention, when the photographic characteristic values obtained by the non-basic development processing are corrected to the photographic characteristic values in the basic development, the gradation and color balance obtained become equal to those of an image information obtained by the basic development. In other words, the image quality exclusive of the sharpness and graininess is almost the same. To speak more specifically, whether or not the image quality is equal is fundamentally evaluated by the observation of the photographic image and the evaluation very relies on a sensory element. However, when importance is attached to the objectiveness, the photographic characteristic values constituting the image quality and determined by measuring the image density may be used. For example, when the gamma value or color balance is within ±10% of the density value basis, the image quality may be said to be equal to that attained by the basic development processing. In the case of a color printer using a normal non-scanning area-wise exposure method, the one-key correction is about 8% and difference within this range is usually allowable. Accordingly, when the photographic characteristic value obtained by the non-basic development processing is within 10% of the basic values, the value can be judged to be allowable.

The characteristic feature of the present invention is described in the foregoing and the present invention is described in more detail below in the following sequence.

1. Development processing to which the present invention is applied
2. Image reproduction of the present invention
3. Output-purpose positive material
4. Color photographic material for photographing, to which the present invention is applied 1. Development Processing to Which the Present Invention is Applied The present invention is described in the forgoing by referring to the international general-purpose common processing such as CN16 processing and C41 processing as the standard development processing, however, the development processing to which the image formation method of the present invention can be applied is not necessarily limited to these international common processings. A color development processing to which the present invention is applied is additionally described below.

The color development tank solution or color developer replenishing solution for use in the development processing of the color negative film of the present invention is an alkaline aqueous solution mainly comprising an aromatic primary amine color developing agent. As the color developing agent, an aminophenol-base compound is useful but a p-phenylenediamine-base compound is preferably used and representative examples thereof include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-β-methoxyethylaniline, 4-amino-3-methyl-N-methyl-N-(3-hydroxypropyl)aniline, 4-amino-3-methyl-N-ethyl-N-(3-hydroxy-propyl)aniline, 4-amino-3-methyl-N-ethyl-N-(2-hydroxypropyl)-aniline, 4-amino-3-ethyl-N-ethyl-N-(3-hydroxypropyl)aniline, 4-amino-3-methyl-N-propyl-N-(3-hydroxypropyl)aniline,4-amino-3-propyl-N-methyl-N-(3-hydroxypropyl)aniline, 4-amino-3-methyl-N-methyl-N-(4-hydroxybutyl)aniline, 4-amino-3-methyl-N-ethyl-N-(4-hydroxybutyl)aniline, 4-amino-3-methyl-N-propyl-N-(4-hydroxybutyl) aniline, 4-amino-3-ethyl-N-ethyl-N-(3-hydroxy-2-methylpropyl)aniline, 4-amino-3-methyl-N,N-bis(4-hydroxybutyl)-aniline, 4-amino-3-methyl-N,N-bis(5-hydroxypentyl)aniline, 4-amino-3-methyl-N-(5-hydroxypentyl)-N-(4-hydroxybutyl)aniline, 4-amino-3-methoxy-N-ethyl-N-(4-hydroxybutyl)aniline, 4-amino-3-ethoxy-N,N-bis(5-hydroxypentyl)aniline,4-amino-3-propyl-N-(4-hydroxybutyl)aniline, and a sulfate, a hydrochloride or a p-toluenesulfonate thereof. Among these, preferred are 3-methyl-4-amino-N-ethyl-N-β-hydroxyethylaniline, 4-amino-3-methyl-N-ethyl-N-(3-hydroxypropyl)aniline, 4-amino-3-methyl-N-ethyl-N-(4-hydroxybutyl)aniline, and a hydrochloride, a p-toluene-sulfonate or a sulfate thereof. These compounds may be used in combination of two or more depending on the purpose.

The amount of the aromatic primary amine developing agent used is 0.01 to 0.2 mol per liter of the color developer. However, the amount of the developing agent used is from 0.02 to 0.2 mol, preferably from 0.025 to 0.1 mol, per liter of the color developer, when the developing agent concentration is used for the purpose of improving graininess according to the present invention. If the amount added is less than the above-described range, sufficiently high effect on the improvement of graininess cannot be obtained, whereas if the amount added exceeds the upper limit of the range as described above, fogging or staining disadvantageously occurs.

The color developer usually contains a pH buffering agent such as a carbonate, borate or phosphate of an alkali metal or a 5-sulfosalicylate, or a development inhibitor or antifoggant such as a chloride salt, a bromide salt, an iodide salt, a benzimidazole, a benzothiazole and a mercapto compound. The color developer may also contain various blending materials, if desired, and representative examples thereof include a preservative such as hydroxylamine, diethylhydroxylamine, hydroxylamines represented by formula (I) of JP-A-3-144446, sulfite, hydrazines (e.g., N,N-biscarboxymethylhydrazine), phenylsemicarbazides, triethanolamine and catecholsulfonic acids; an organic solvent such as ethylene glycol and diethylene glycol; a development accelerator such as benzyl alcohol, polyethylene glycol, quaternary ammonium salts and amines; a dye-forming coupler; a competing coupler; an auxiliary developing agent such as 1-phenyl-3-pyrazolidone; a tackifying agent; and various chelating agents including aminopolycarboxylic acid, aminopolyphosphonic acid, alkylphosphonic acid and phosphonocarboxylic acid, such as ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-l,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and a salt thereof.

Among these blending materials, the preservative is preferably an unsubstituted hydroxylamine or a substituted hydroxylamine, more preferably diethylhydroxylamine, mono-methylhydroxylamine or a hydroxylamine having an alkyl group substituted with a water-soluble group such as a sulfo group, a carboxy group or a hydroxyl group, as the substituent, and most preferably N,N-bis(2-sulfoethyl) hydroxylamine or an alkali metal salt thereof.

The antifoggant is preferably bromide ion, and the amount of the bromide ion added is from 0.010 to 0.014 mol/l. However, as described above, the amount of the bromide ion added is preferably from 0.015 to 0.1 mol/l, more preferably from 0.02 to 0.05 mol/l where it is used as a means for achieving the object of the present invention to increase the bromide ion concentration.

The chelating agent is preferably a compound having biodegradability, and examples thereof include the chelating agents described in JP-A-63-146998, JP-A-63-199295, JP-A-63-267750, JP-A-63-267751, JP-A-2-229146, JP-A-3-186841, German Patent No. 3,739,610 and European Patent No. 468,325.

The processing solution in the replenishing tank for the color developer is preferably shielded by a liquid agent such as a high boiling point organic solvent, to reduce the contact area with air. The liquid shielding agent is most preferably liquid paraffin.

In the processing with a color developer, the processing temperature is from 37 to 55° C., preferably from 37 to 50° C., and the processing time is from 30 seconds to 4 minutes, preferably from 45 seconds to 2 minutes and 00 second, most preferably from 50 seconds to 1 minute and 30 seconds. In the case when out of the above-described four conditions for improving graininess and sharpness according to the present invention, only the processing time is a condition for achieving the object of the present invention, the processing time is from 45 seconds to 2 minutes and 00 second and in the case when out of the four conditions, only the processing temperature is a condition for achieving the object of the present invention, the processing temperature is from 40 to 55° C.

In this processing method, the light-sensitive material is desilvered after the color development. The desilvering step is described in detail below.

The desilvering step generally comprises a bleaching step, a bleach-fixing step and a fixing step, and various series of steps may be used. Specific examples thereof are described below, but the present invention is by no means limited thereto.

(Step 1) bleach-fixing (Step 2) bleaching—bleach-fixing (Step 3) bleaching—bleach-fixing—fixing (Step 4) fixing—bleach-fixing (Step 5) bleaching—fixing Each processing bath may be divided into two or more baths, if desired, or may be replenished by the cascade method.

The bleaching agent for use in the processing solution having bleaching ability is aminopolycarboxylic acid iron (III) complex, persulfate, bromate, hydrogen peroxide or red prussiate, most preferably aminopolycarboxylic acid iron (III) complex.

The ferric complex salt for use in this processing method may be added and dissolved as an iron complex salt prepared by previously performing complexing, or a complex-forming compound and a ferric salt (e.g., ferric sulfate, ferric chloride, ferric bromide, iron(III) nitrate, ammonium iron (III) sulfate) are allowed to be present in the solution to form a complex in the solution having bleaching ability.

The complex-forming compound may be added slightly in excess of the amount necessary for the complex formation with the ferric ion, and when the compound is added in excess, the excess by from 0.01 to 10% is usually preferred. Examples of the compound which forms a ferric complex salt in the solution having bleaching ability include ethylene-diaminetetraacetic acid (EDTA), 1,3-propanediaminetetraacetic acid (1,3-PDTA), diethylenetriaminepentaacetic acid, 1,2-cyclohexanediaminetetraacetic acid, iminodiacetic acid, methyliminodiacetic acid, N-(2-acetamido)iminodiacetic acid, nitrilotriacetic acid, N-(2-carboxyethyl)iminodiacetic acid, N-(2-carboxymethyl) iminodipropionic acid, β-alaninediacetic acid, α-methylnitrilotriacetic acid, 1,4-diaminobutanetetraacetic acid, glycol ether diaminetetraacetic acid, N-(2-carboxyphenyl) iminodiacetic acid, ethylenediamine-N-(2-carboxyphenyl)-N,N',N'-triacetic acid, ethylenediamine-N,N'-disuccinic acid, 1,3-diaminopropane-N,N'-disuccinic acid, ethylenediamine-N,N'-dimalonic acid and 1,3-diaminopropane-N,N'-dimalonic acid, however, the present invention is by no means limited thereto.

The concentration of the ferric complex salt in the processing solution having bleaching ability is suitably from 0.005 to 1.0 mol/l, preferably from 0.01 to 0.50 mol/l, more preferably from 0.02 to 0.30 mol/l.

The concentration of the ferric complex salt in the replenishing solution for the processing solution having bleaching ability is preferably from 0.005 to 2 mol/l, more preferably from 0.01 to 1.0 mol/l.

The bath having bleaching ability or a pre-bath thereof may use various compounds as the bleaching accelerator and, for example, compounds having a mercapto group or disulfide bond described in U.S. Pat. No. 3,893,858, German Patent 1,290,812, JP-A-53-95630 and *Research Disclosure*, No. 17129 (Jul., 1978), and thiourea-base compounds or halides such as iodine and bromide ions described in JP-B-45-8506 (the term "JP-B" as used herein means an "examined Japanese patent publication"), JP-A-52-20832, JP-A-53-32735 and U.S. Pat. No. 3,706,561 are preferred because of their excellent bleaching ability.

In addition, the bath having bleaching ability may contain a rehalogenating agent such as a bromide (e.g., potassium bromide, sodium bromide, ammonium bromide), a chloride (e.g., potassium chloride, sodium chloride, ammonium chloride) and an iodide (e.g., ammonium iodide). If desired, the bath having bleaching ability may contain one or more of inorganic acids and organic acids having a pH buffering ability and an alkali metal or ammonium salt thereof, such as borax, sodium metaborate, acetic acid, sodium acetate, sodium carbonate, potassium carbonate, phosphorous acid, phosphoric acid, sodium phosphate, citric acid, sodium citrate, tartaric acid, malonic acid, succinic acid and glutaric acid, and may further contain anti-corrosion agents such as ammonium nitrate and guanidine.

The bath having bleaching ability may additionally contain a whitening agent, a defoaming agent, a surface active agent and an organic solvent such as polyvinylpyrrolidone and methanol.

The fixing agent component used in the bleach-fixing solution or fixing solution is preferably a thiosulfate. Examples of the thiosulfate include sodium thiosulfate, potassium thiosulfate and ammonium thiosulfate. Other known fixing agents may also be used and examples thereof include thiocyanates such as sodium thiocyanate and ammonium thiocyanate, and water-soluble silver halide dissolving agents such as a thioether compound (e.g., ethylenebisthioglycolic acid, 3,6-dithia-1,8-octanediol), a mesoionic compound and a thiourea. In the present invention, a thiosulfate is preferred, and ammonium thiosulfate, potassium thiosulfate and sodium thiosulfate are more preferred. The total amount of the fixing agent is preferably from 0.3 to 3.0 mol/l, more preferably from 0.5 to 2.0 mol/l.

The bleach-fixing solution or fixing solution preferably contains a sulfite (or bisulfite, metabisulfite) as the preservative, and the sulfite is preferably added in an amount of from 0.03 to 0.5 mol/l, more preferably from 0.05 to 0.3 mol/l.

In addition to the sulfite ion-releasing compound referred to above as the preservative, such as sulfite (e.g., sodium sulfite, potassium sulfite, ammonium sulfite), bisulfite (e.g., ammonium bisulfite, sodium bisulfite, potassium bisulfite), metabisulfite (e.g., potassium metabisulfite, sodium metabisulfite, ammonium metabisulfite), the bleach-fixing solution or fixing solution may contain an aldehyde (e.g., benzaldehyde, acetaldehyde), a ketone (e.g., acetone), an ascorbic acid, a hydroxylamine, a benzenesulfinic acid or an alkylsulfinic acid, if desired. In particular, a benzene-sulfinic acid, p-methylbenzenesulfinic acid and a p-aminobenzenesulfinic acid are preferred. The amount added is preferably on the order of from 0.005 to 0.3 mol/l.

Furthermore, the bleaching solution, bleach-fixing solution or fixing solution may contain a buffering agent, a whitening agent, a chelating agent, a defoaming agent and an antifungal, if desired.

The pH region of the bleaching solution, bleach-fixing solution or fixing solution is preferably from 4 to 8, more preferably from 4.5 to 6.5.

The replenishing amount to the bleaching solution, bleach-fixing solution or fixing solution is from 50 to 2,000 ml per $m^2$ of the light-sensitive material. The overflow solution from the water washing or stabilization bath as a post bath may also be used as the replenishing solution, if desired.

The temperature at the processing with the bleaching solution, bleach-fixing solution or fixing solution is from 20 to 50° C., preferably from 30 to 45° C. The processing time in each step is from 10 seconds to 3 minutes, preferably from 20 seconds to 2 minutes.

The processing solution having bleaching ability is particularly preferably aerated during the processing so that the photographic capability can be very stably maintained. The aeration can be performed using a means known in the art and for example, air is blown into the processing solution having bleaching ability or air is absorbed thereinto using an executer.

The aeration may be performed directly in the processing tank, however, in order to prevent the mixing of other solutions, the aeration is preferably performed in the stock tank.

The blowing of air is preferably performed by releasing air into the solution through a diffusion tube having fine pores. Such a diffusion tube is widely used, for example, in an aeration tank for the activated sludge processing. With respect to the aeration, the matters described in *Z-121, Using Process C*-41, 3rd edition, pages BL-1 to BL-2, published by Eastman Kodak Co. (1982) may be used. In the processing using the processing solution having bleaching ability of the present invention, stirring is preferably intensified and for the intensification, the contents described in JP-A-3-33847, page 8, right upper column, line 6 to left lower column, line 2 can be used as it is.

In the development processing device of the present invention, the aeration is preferably performed in the circulation system or stock tank.

The light-sensitive material is generally subjected to water washing and/or stabilization after the desilvering process.

In the water washing and/or stabilization step, the concentration of thiosulfate remaining in the processed light-sensitive material needs be adjusted to from 30 to 1,500 $\mu mol/m^2$.

More specifically, the concentration of the thiosulfate in the final bath is preferably adjusted to approximately from 0.001 to 0.04 mol/l. To this effect, thiosulfate in the above-described concentration may be added to the final bath or when thiosulfate is used as the fixing component, the replenishing amount in the water washing or stabilization step subsequent to the desilvering step is preferably reduced so that the final bath can have the above-described concentration.

Although the replenishing amount varies depending on the concentration of thiosulfate at the fixing step or the number of baths in the water washing step or stabilization step, it is approximately from 100 to 1,000 ml, preferably from 130 to 700 ml, per $m^2$ of the light-sensitive material.

With respect to the amount of washing water in the water washing step, the relationship between the number of water washing tanks and the amount of water in a multi-stage countercurrent system can be obtained according to the method described in *Journal of the Society of Motion Picture and Television Engineers*, Vol. 64, pp. 248–253 (May, 1955). According to the multi-stage countercurrent system described in the above-described publication, the amount of washing water may be greatly reduced but due to the increase in the residence time of water in the tank, a problem is caused such that bacteria proliferate and the floats generated adhere to the light-sensitive material.

In order to solve such a problem in the processing of a color light-sensitive material, a method of reducing calcium ion or magnesium ion described in JP-A-62-288838 can be very effectively used. Further, isothiazolone compounds and thiabendazoles described in JP-A-57-8542, chlorine-based bactericides such as sodium chlorinated isocyanurate, and bactericides such as benzotriazoles, described in Hiroshi Horiguchi, *Bokin, Bobai-Zai no Kagaku* (*Chemistry of Bactericide and Antifungal*), Sankyo Shuppan (1986), *Biseibutsu no Mekkin, Sakkin, Bobai-Giiutsu* (*Germicidal, Bactericidal and Antifungal Technology of Microorganism*) compiled by Eisei Gijutsu Kai, issued by Kogyo Gijutsu Kai (1982), and *Bokin-Bobai Zai Jiten* (*Lexicon of Bactericide and Antifungal*) compiled by Nippon Bokin Bobai Gakkai (1986) may also be used.

The pH of the final bath in the processing of a light-sensitive material may be freely selected, however, it is preferably from 3.5 to 8, more preferably from 4 to 7. This pH is preferably set to reflect on the layer pH of the processed light-sensitive material and for this purpose, various buffering agents may be used. Specific examples of the buffering agent include acetic acid, malonic acid, succinic acid, malic acid, maleic acid and phthalic acid.

The processing temperature and the processing time at the water washing may also be variously set according to the characteristics and use of the light-sensitive material, but they are commonly from 20 to 45° C. and from 20 seconds to 5 minutes, preferably from 25 to 40° C. and from 30 seconds to 3 minutes, respectively. The light-sensitive material for use in the present invention may also be processed directly with a stabilizing solution in place of the above-described water washing. In such a stabilization processing, any known method described in JP-A-57-8543, JP-A-58-14834 and JP-A-60-220345 may be used.

The stabilizing solution contains a compound which stabilizes the dye image, for example, a benzaldehyde such as formalin or m-hydroxybenzaldehyde, a formaldehyde bisulfite addition product, a hexamethylenetetramine or a compound thereof, a hexahydrotriazine or a compound thereof, a dimethylolurea, a N-methylol compound such as N-methylolpyrazole, an organic acid or a pH buffering agent. The amount of the compound added is preferably from 0.001 to 0.02 mol per L of the stabilizing solution, however, the concentration of free formaldehyde in the stabilizing solution is preferably lower because splashing of formaldehyde gas is reduced. In this point of view, preferred examples of the dye image stabilizer are N-methylolazoles such as m-hydroxybenzaldehyde, hexamethylene tetramine and N-methylolpyrazole described in JP-A-4-270344, and azolylmethylamines such as N,N'-bis(1,2,4-triazol-1-ylmethyl)piperazine described in JP-A-4-313753. Particularly, a combination use of an azole such as 1,2,4-triazole described in JP-A-4-359249 (corresponding to EP-A-519190) with azolylmethylamine or a compound thereof such as 1,4-bis(1,2,4-triazolyl-1-ylmethyl) piperazine is preferred because high image stability is obtained and the formaldehyde vapor pressure is low. Furthermore, if desired, the stabilizing solution preferably contains an ammonium compound such as ammonium chloride and ammonium sulfite, a metal compound such as Bi and Al, a whitening agent, a hardening agent, an alkanolamine described in U.S. Pat. No. 4,786,583, and a preservative which can be contained in the above-described fixing solution or bleach-fixing solution, such as a sulfinic acid compound described JP-A-1-31051.

The washing water and/or stabilizing solution may contain various surface active agents so as to prevent water droplet unevenness at the drying of a processed light-sensitive material. In particular, a nonionic surface active agent is preferably used and an alkylphenol-ethylene oxide adduct is more preferred. The alkylphenol is more preferably octyl, nonyl, dodecyl or dinonylphenol, and the addition molar number of the ethylene oxide is preferably from 8 to 14. Also, a silicone-base surface active agent having a high defoaming effect is preferably used.

The washing water and/or stabilizing solution preferably contains various chelating agents. Preferred examples of the chelating agent include aminopolycarboxylic acids such as ethylenediaminetetraacetic acid and diethylenetriaminepentaacetic acid, organic phosphonic acids such as 1-hydroxyethylidene-1,1-diphosphonic acid, N,N,N'-trimethylenephosphonic acid and diethylenetriamine-N,N,N',N'-tetramethylenesulfonic acid, and hydrolysates of a maleic anhydride polymer described in EP-A-345172.

2. Image Reproduction of the Present Invention

The image reproduction comprises reading of the image information from the developed film, picture processing of the image information read and taking out of the image information modified by the picture processing.

2.1 Reading of Image Information from Developed Film

FIG. 2 shows a block diagram showing the fundamental construction of the color image reproduction system of the present invention. As shown in FIG. 2, the image reproduction system is equipped with an image reading device 1 for producing digitized image data by reading the color image, a picture processing device 5 for performing a predetermined picture processing of the image data produced by the image reading device 1, and an image output device 8 for reproducing a color image based on the image data subjected to the picture processing by the picture processing device 5.

The image reading may be performed predominantly by the following three methods:

(i) a method of winding a film around a rotating drum, rotating the drum and simultaneously making sub-scanning in the drum direction while irradiating a measurement beam combined with a color separation filter, photoelectrically converting the reflection density of each picture element through a photomultiplier to read it as an electrical signal, and amplifying the signal;

(ii) a line CCD-scanning method of sub-scanning an image on a developed film using a line CCD having one-dimensionally arrayed light-receiving elements to receive the transmission or reflection density on the line CCD, and converting it into an electrical signal by electric scanning; and (iii) an area CCD method of reading the density of a two-dimensional picture element as it is using an area CCD and converting the density values of two-dimentional picture elements read with the area CCD into an electrical signal by rearranging them in time series by the electric scanning.

Any one of these methods may be used but the area CCD method is particularly preferred. Hereinafter, the description is made on the assumption that the CCD method is used, however, the present invention can be practiced without causing any trouble also by other two methods.

FIG. 3 shows an appearance of the image reproduction system of FIG. 2. As shown in FIG. 3, the image reproduction system in practice is constructed such that as the image reading device 1, a transmission-type image reading device 10 for photoelectrically reading a color image recorded on a film or a reflection-type image reading device 30 for photoelectrically reading a color image recorded on a color print is selectively connected to the picture processing device 5. Accordingly, either a color image recorded on a film or a color image recorded on a color print can be reproduced. However, the image reading device for the color negative film which is concerned in the present invention, is described here.

FIG. 4 is a schematic view of the transmission-type image reading device 10 for the color image reproduction system for producing image data based on a color image. As shown in FIG. 4, the transmission-type image reading device 10 is constructed so that a color image recorded on a film F can be photoelectrically read by irradiating light on the color image and detecting the light transmitted through the film, and the device comprises a light source 11, a light control unit 12 capable of controlling the quantity of light emitted from the light source 11, a light separation unit 13 for separating the light emitted from the light source 11 into three colors of R (red), G (green) and B (blue), a diffusion unit 14 for diffusing the light so that the light emitted from the light source 11 can be uniformly irradiated on the film F, a CCD area sensor 15 for photoelectrically detecting the light transmitted through the film F, and an electric zoom lens 16 for gathering the light transmitted through the film F on the CCD area sensor 15 to form an image. The transmission-type image reading device 10 can read various films by exchanging the film carrier not shown, such as 135 negative film, 135 positive film and advanced photosystem (APS) film.

The light source 11 used is a halogen lamp and the light controlling unit 12 is designed so that the quantity of light can change in exponential to the travel by the movement of two throttle plates. The color separation unit 13 separates the color into three colors in the order by rotating a disk having R, G and B three filters. The CCD area sensor 15 has light-receiving elements each comprising longitudinally 920 picture elements and vertically 1,380 picture elements and can read the image information on the film with high resolving power. The CCD area sensor 15 is constructed such that the image data in the odd field comprising the image data of an odd line of the photoelectrically read image and the image data in the even field comprising the image data of an even line are transferred in sequence, when color image is read.

The transmission-type image reading device 10 (see FIG. 3) is further equipped with an amplifier 17 for amplifying the R, G and B image signal photoelectrically detected and produced by the CCD area sensor 15, an A/D convertor 18 for digitizing the image signal, a CCD correction means 19 for correcting the distribution of sensitivity among the picture elements or the dark current of the image signal digitized by the A/D convertor 18, and a log convertor 20 for converting the R, G and B image data into density data. The log convertor 20 is connected to an interface 21.

Film F is held by a carrier 22, the film F held by the carrier 22 is transferred to a predetermined position by the driving roller 24 driven by a motor 23 and press held in the stopped state. After reading of a color image in one frame is completed, the film is transferred by one flame portion. As the automatic carrier for handling the negative film, those conventionally used in mini laboratories, such as NC135S manufactured by Fuji Film Co., Ltd., may be used. An image in the range corresponding to the print form such as full size, panorama size or powerful size, may be read. When a trimming carrier conventionally used in mini laboratories is used, enlargement at about 1.4 magnification with respect to the center as an axis may be obtained. Or, as the reversal carrier, those disclosed in JP-A-9-114011, JP-A-9-114016, JP-A-9-114017, JP-A-9-120104 and JP-A-9-130557 may be used (although the reversal carrier is not directly relevant to the present invention).

The picture plane detecting sensor 25 detects the density distribution of a color image recorded on the film F and takes out the detected density signal to a CPU 26 which controls the transmission-type image reading device 10. The CPU 26 calculates, based on this density signal, the picture plane position of the color image recorded on the film F, and when it is judged that the picture plane position of the color image reached the predetermined position, stops the driving of the motor 23.

The image reading device may be disposed at any site such as inlet or outlet of the drying part of the developing machine or may be appended to an independent reading/picture processing apparatus or a printer part.

2.2 Picture Processing of Image Information After Reading

The image reading device 1 shown by FIG. 1 and FIG. 2 is described in detail above. The picture processing device 5 similarly shown by FIG. 1 and FIG. 2 is described below.

FIG. 5 and FIG. 6 are two divided parts of the block diagram showing the construction of the picture processing device 5. As shown in FIG. 5 and FIG. 6, the picture processing device 5 comprises an interface 48 connectable to the interface 21 of the transmission-type image reading device 10 or the interface 41 of the reflection-type image reading device 30, an addition average operation means 49 for adding the values of two adjacent picture element data of the image data produced by the image reading device 1 and transferred per line and averaging the added values to gain one picture element data, a first line buffer 50*a* and a second line buffer 50*b* for alternately storing the picture element data in each line of the image data transferred from the addition average operation means 49, and a first frame memory unit 51, a second frame memory unit 52 and a third frame memory unit 53 for storing the image data corresponding to one frame color image recorded on the film F (see FIG. 4) based on the line data stored and transferred by the line buffers 50*a* and 50*b*. The first line buffer 50*a* and the second line buffer 50*b* are constructed such that the odd line picture element data of the image data and the even line picture element data are stored alternately in one line buffer and then in another line buffer.

According to the embodiment of the present invention, first reading (hereinafter referred to as "look-ahead") of one frame color image recorded on the film F is performed by the image reading device 1 and the image read is converted into digital image data. At this time, based on the image data read by this look-ahead, the image reading conditions in the subsequent second reading (hereinafter referred to as "main reading") performed by the picture processing device 5 are established. Based on the reading conditions established, the color image is again read, namely, main reading is performed, to thereby produce digital image date to be subjected to picture processing for the reproduction. For performing such processing, the picture processing device 5 is constructed such that the image data obtained by the look-ahead is stored in the first frame memory unit 51 and the image data obtained by the main reading is stored in the second frame memory unit 52 and the third frame memory unit 53.

Before describing other constituent elements shown in FIG. 5 and FIG. 6, these frame memory units are described in detail. FIG. 7 shows a block diagram showing details of the first frame memory unit 51, the second frame memory unit 52 and the third frame memory unit 53. As shown in FIG. 7, for processing the image data produced by reading a color image, the first frame memory unit 51, the second frame memory unit 52 and the third frame memory unit 53 each comprises R data memory 51R, G data memory 51G and B data memory 51B, R data memory 52R, G data memory 52G and B data memory 52B, or R data memory 53R, G data memory 53G and B data memory 53B, for storing the image data corresponding to R (red), G (green) and B (blue), respectively. In the first frame memory unit 51, the image data obtained by the look-ahead is stored, and in the second and third frame memory units 52 and 53, the image data obtained by the main reading is stored. FIG. 7 shows the state where the image data obtained by the look-ahead is taken in from an input bus 63 to the first frame memory unit 51 and the image data stored in the second frame memory unit 52 is taken out to an output bus 64.

The construction of the picture processing device 5 is again described by referring to FIG. 5 and FIG. 6. The picture processing device 5 comprises a CPU 60 for controlling the entire of the image processing device 5. The CPU 60 is constructed to be communicable with the CPU 26 (see FIG. 4) for controlling the transmission-type image reading device 10 through a communication wire (not shown) and at the same time, communicable with the CPU for controlling an image output device 8 which will be described later, through a communication wire (not shown). As having this construction, the CPU 60 can change the image reading conditions for main-reading a color image based on the image data obtained by the look-ahead and stored in the first frame memory unit 51 and if desired, further change the picture processing conditions in the picture processing performed on the image after the reading.

More specifically, the CPU 60 determines the image reading conditions for the main reading based on the image data obtained by the look-ahead so that the CCD area sensor 15 or the CCD line sensor 35 can effectively use the dynamic range at the time of main reading, and take out the reading control signal to the CPU 26 of the transmission-type image reading derive 10 or (although not concerned in the present invention) to the CPU 46 of the reflection-type image reading device 30. When the reading control signal is taken in, the CPU 26 of the transmission-type image reading device 10 or the CPU 46 of the reflection-type image reading device 30 controls the quantity of light to be adjusted by the light control unit 12 or the light control unit 34, and the storage time of the CCD area sensor 15 or CCD line sensor 35. At the same time, based on the image data obtained, the CPU 60 takes out a control signal for changing the picture processing conditions such as parameters in the picture processing by a first picture processing means and a second picture processing means, which will be described later, to the first picture processing means and the second picture processing means, if desired, so that a color image having optimal density, gradation and color tone can be reproduced on a color paper. At this time, the image reading conditions and the picture processing conditions determined by CPU 60 are stored in memory 66.

On the occasion of the CPU 60 performing the control, when image reading conditions or picture processing conditions are held by the indication of an operator, the CPU 60 does not decide the conditions based on the image data obtained by the look-ahead but takes in various control signals based on the holding conditions. When an operator sets various conditions and indicates the holding thereof by an input device such as a keyboard 69, these conditions are stored in a memory 66 and when the operator afterward indicates the cancellation of the holding of these conditions, the conditions stored in the memory 66 are nullified. Accordingly, at the time of performing the above-described control, the CPU 60 first refers to the conditions stored in the memory 66. When the conditions are stored, the CPU 60 follows the conditions and when not stored, decides the conditions based on the image data obtained by the look-ahead. Therefore, the operator may indicate the setting of the conditions according to the kind of the film by reading it from the DX code or following the special order of users or may previously set the conditions according to respective kinds of film so that the processing in accordance with the indication can be automatically performed. These conditions are not necessarily held in a large unit such as image reading conditions or picture processing conditions, but full and particular conditions may also be stored in the memory 66 to such that, for example, the setting of saturation is held but for the sharpness, the automatically decided condition is used.

The construction of the picture processing device 5 in the range shown by FIG. 5 was described above. That is, the processing performed on the image data in the period of from the image data produced by the image reading device 1 is taken in to the picture processing device 5 through the interface 48 until the image data is stored in the first to third frame memory units was described in detail.

The construction of the picture processing device 5 for performing the picture processing on an image data stored as a result of main reading in the second frame memory unit 52 and the third frame memory unit 53 is described below.

The picture processing device 5 comprises a first picture processing means 61 (see FIG. 6) for performing the picture processing such as gradation correction, color conversion and density conversion on the image data stored in the second frame memory unit 52 and the third frame memory unit 53 by the look up table or matrix operation so that a color image having desired density, gradation and color tone can be reproduced on a color paper, and a second picture processing means 62 (see FIG. 6) for performing the picture processing such as gradation correction, color conversion and density conversion on the image data stored in the first frame memory unit 51 by the look up table or matrix operation so that a color image having desired image quality can be reproduced on the faceplate of CRT which will be described later. The output of the second frame memory unit 52 and the third frame memory unit 53 is connected to a selector 55 and through the selector 55, the image data stored either in the second frame memory unit 52 or the third frame memory unit 53 are selectively taken in to the first picture processing means 61.

FIG. 8 is a block diagram showing the details of the first picture processing means 61. As shown in FIG. 8, the first picture processing means 61 comprises a color density gradation converting means 100 for converting the density data, color data and gradation data of the image data, a saturation converting means 101 for converting the saturation data of the image data, a digital magnification converting means 102 for converting the picture element data number of the image data, a frequency processing means 103 for performing the frequency processing on the image data, and a dynamic range conversion means 104 for converting the dynamic range of the image data. These conversion means usually employ a system called a pipeline processing where respective processing means are simultaneously actuated and after completion of the actions, processing of subsequent conversion means starts. Accordingly, a high-speed processing can be achieved.

By the picture processing means shown in FIG. 8, not only the processing such as gradation correction, color conversion and density conversion but also a processing of improving the sharpness while controlling the graininess of the film to a certain degree can be performed (this technique has been filed as Japanese Patent Application No. 7-337510 corresponding to JP-A-9-22460). Furthermore, an automatic cover printing processing for obtaining good image reproduction of an image having a large shadow contrast can also be performed (this technique has been filed as Japanese Patent Application No. 7-165965 corresponding to JP-A-9-18704).

The first picture processing means 61 is connected to the data composing means 75 shown in FIG. 6, to which the composite data memory 76 is connected. The composite data memory 76 comprises R data memory 76R, G data memory 76G and B data memory 76B which store the image data such as figures and letters corresponding to R (red), G (green) and B (blue), respectively. The composite data memory 76 stores the image data such as figures and letters which should be composed with the image data obtained by reading the color image recorded on the film F (see FIG. 3) or the color print P (see FIG. 4), when the image data obtained by reading color image recorded on the film F or the color print P are composed with the image data stored in the composite data memory 76 to reproduce a color image on color paper by image output device 8, which will be described later. The date composing means 75 is connected to interface 77.

In the present invention, the graininess of the film itself is improved by the change of the development processing conditions, however, (i) linearity of the gradation is lost, (ii) the sharpness is slightly bad and (iii) the color balance is deteriorated. Accordingly, by the above-described processing means, the picture processing conditions for correcting the photographic properties from the digitized image information read to the standard image quality are set and based on the conditions established, conversion into standard photographic properties is performed and after once stored, the converted image information proceeds to the stage for taking out a positive image to a printer.

In the above-described picture processing in series for the image reproduction, the correction of (i) the non-linear gradation is performed by modifying the characteristic curve form at the foot part and the high density part to approximate to the characteristics at the time of basic development, using a combination of the dynamic range conversion means 104 and the gradation conversion means 100. At the same time, (ii) the sharpness is improved in such a manner that the picture element data number of the picture element data is increased or decreased by the digital magnification conversion means 102 according to the size of a positive image to be taken out and then the picture element data is subjected to the frequency processing such as contrast intensification or edge stressing of the portion contributing to the sharpness by the frequency processing means 103. The color balance (iii) is adjusted by using the saturation conversion means 101 and the color density gradation conversion means 100 in combination. The trailing directly related to the sensitivity is also modified using the saturation stressing by the saturation conversion means 101, the dynamic range conversion means 104 and the gradation conversion means 100 in combination. Furthermore, the image sharpness is improved by modifying the characteristic curve form at the foot portion and the high density portion using a combination of the change in the density amplification degree of high spatial frequency components by the frequency processing means 103 and the control of gradation by the gradation conversion means 100. Also in this case, similar to the reproduction of the gradation (contrast intensification), when reproduction of the characteristics by the basic development processing is not successfully achieved using the picture processing conditions already established, re-setting of the picture processing conditions is performed.

By further combining a processing for stressing the fringe of an image and a processing for increasing the gradation at the low density part, the image sharpness as a whole and at the fine image part may be improved, however, this is performed by the frequency processing means 103. More specifically, the spatial frequency of the image part is analyzed and an exalting processing is set for the fringe part where the frequency greatly changes and for the fine image part where the frequency increases.

The precision in the modification of the gradation and the color balance by the picture processing may be sufficient if it falls within 10%, preferably 8%, of the target value set in terms of the density value, as described above. When the color balance and the gradation property, in terms of the density value, of the above-described range are obtained, the image reproduction is judged to be successful.

For performing the conversion to the standard photographic characteristic values, conversion conditions may be set for respective kinds of film so that after reading the kind of the film processed, the conditions can be automatically selected, or an operator may indicate the conversion processing conditions according to the film processed.

The action details of the picture processing device used for the above-described picture processing are disclosed in JP-A-10-020457 and JP-A-9-146247.

The picture processing device 5 comprises a data bus 65 separately from an input bus 63 and an output bus 64 for the first frame memory unit 51, the second frame memory unit 52 and the third frame memory unit 53. The data bus 65 is connected to the CPU 60 for controlling the entire color image reproduction system, a memory 66 for housing the operation program of the CPU 60 or data regarding the picture processing conditions, a hard disk 67 capable of storing and saving the image data, a CRT 68, a keyboard 69, a communication port 70 to be connected to another color forming reproduction system through a telecommunication line, and a communication wire to the CPU 26 of the transmission-type image reading device 10.

2.3 Output of Picture-processed Image Signal to Printer

The construction of the picture processing device 5 shown in FIG. 2 and FIG. 3 is described in detail above. The image output device 8 similarly shown by FIG. 2 and FIG. 3 is described below.

The output of the image information is described mainly referring to a color paper which is the main output object of the present invention, however, the material to which the image information is taken out in the present invention is not limited thereto. FIG. 9 is a schematic view of an image output device 8 for the color image reproduction system for reproducing a color image on a color paper based on the image data processed by the picture processing device according to the preferred embodiment of the present invention.

In FIG. 9, the image output device 8 comprises an interface 78 connectable to the interface 77 of the image processing device 5, a CPU 79 for controlling the image output device 8, an image data memory 80 comprising a plurality of frame memories for storing the image data taken in from the picture processing device 5, a D/A convertor 81 for converting the image data to an analog signal, a laser beam irradiation means 82 and a modulator driving means 83 for taking out a modulation signal for modulating the strength of the laser beam. The CPU 79 is constructed to be communicable with the CPU 60 of the picture processing device 5 through a communication wire (no shown).

FIG. 10 is a schematic view of the laser beam irradiation means 82 shown in FIG. 9. The laser beam irradiation means comprises semiconductor laser light sources 84*a*, 84*b* and 84*c*. The laser beam emitted from the semiconductor laser light source 84*b* is converted to a green laser beam having a wavelength of 532 nm by the wavelength conversion means 85 and the laser beam emitted from the semiconductor laser light source 84*c* is converted to a blue laser beam having a wavelength of 473 nm by the wavelength conversion means 86.

The red laser beam having an optional wavelength between 670 nm and 690 nm emitted from the semiconductor laser light source 84*a*, the green laser beam converted in the wavelength by the wavelength conversion means 85, and the blue laser beam converted in the wavelength by the wavelength conversion means 86 are constructed to enter the light modulators 87R, 87G and 87B, respectively, such as an acoustic optical modulator (AOM). Modulation signals are taken in to each of-the light modulators 87R, 87G and 87B from the modulator driving means 83 and the strength of the laser beam is modulated according to the modulation signal. At this time, when the semiconductor laser light source 84*a* can be actuated at a high speed, the red laser beam can be directly modulated and the light modulator 87R can be omitted.

The laser beams modulated in the strength by the light modulators 87R, 87G and 87B are reflected by the reflection mirrors 88R, 88G and 88B and enter at a polygon mirror 89. At this time, the paper is transported at a rate of about 75 mm/sec, the scanning line density is 600 lines/inch, and each picture element is modulated every 100 nsec.

The image output device 8 comprises a magazine 91 housing a rolled color paper 90. The color paper 90 having the paper width is constructed to be transported at a rate of about 110 mm/sec in the sub-scanning direction along a predetermined transportation route. The color paper which can be used has a width of from 89 to 210 mm. Common color paper used in mini laboratories or dedicated color paper suitable for high illuminance short-time exposure peculiar to the laser exposure may also be used. The magazine 91 is one usually used in mini laboratories described, for example, in JP-A-6-161050. On the transportation route of the color paper 90, a perforation means 92 for perforating a reference hole on the side edge part of the color paper 90 at an interval corresponding to the length of one sheet color print is provided and in the image output device 8, transportation of the color paper 90 is designed to synchronize with driving of other means according to this reference hole.

The laser beams modulated by the light modulators 87R, 87G and 87B are scanned in the main scanning direction by the polygon mirror 89 to expose the color paper 90 through a lens 93. Since the color paper 90 is being transported in the sub-scanning direction, the entire surface thereof is exposed to the laser beams. The transportation speed of the color paper 90 to the sub-scanning direction is controlled by the CPU 79 so as to synchronize with the main scanning speed of the laser beams, namely, the rotation speed of the polygon mirror 89.

The color paper 90 exposed by the laser beams is transferred to the development processing part 94 at a rate of about 29 mm/sec and subjected to predetermined color development processing, bleach-fixing processing and water washing processing. As a result, a color image is reproduced on the color paper 90 based on the image data picture-processed by the picture processing device 5. The color paper 90 passed through the color development processing, bleach-fixing processing and water washing processing in a color development tank 94, a bleach-fixing tank 95 and a water washing tank 96 is transferred to the drying part 97 and dried. Thereafter, the color paper 90 is cut into a length corresponding to the color image recorded on one frame of film F or one sheet of color paper P based on the reference hole perforated on the side edge part of the color paper 90 by a cutter 98 driven synchronistically with the transportation of the color paper 90, transferred to the sorter 99, and accumulated by the number of sheets corresponding to one roll film F or by every user. For the sorter, a patent application has been separately filed (Japanese Patent Application No. 2-332146 corresponding to JP-A-4-199052).

The color development tank 94, the bleach-fixing tank 95, the water washing tank 96, the drying part 97, the cutter 98 and the sorter 99 may be those usually used in an automatic developing machine at mini laboratories. In the embodiment described, the processing method CP47L is used, however, CP40FA and CP43FA (processing and light-sensitive materials both are produced by Fuji Photo Film Co., Ltd.) may be used and further other general-purpose processing may also be used.

In the embodiment described, the distribution in the properties of the color paper used, and the distribution in the characteristics of the laser light source, modulator and development processing machine are absorbed and stable image reproduction is attained, accordingly, calibration of image output device can be performed. First, in the density data stored as the digital data, the cyan, magenta and yellow three monochromatic colors and the gray obtained by superposing the three colors each is exposed through a plurality of density step patterns and after development, the densities developed each is automatically measured by a densitometer. Based on the difference between the target density and the measured density, the table storing the characteristic value of the electrical signal to be transferred to the modulator at the time of exposure is rewritten for obtaining the density to be reproduced. As a result, an image can be always stably reproduced without being affected by the paper used, apparatus or environmental change. Thus, the image output device is controlled and thereby, stable image reproduction can be always achieved.

3. Output-purpose Positive Material

Any material on that an electrical or optical image signal in time series can be recorded may be used as output-purpose material for obtaining a positive image, and examples thereof include ink jet, sublimation thermosensitive transfer, color diffusion transfer, color electrophotography, heat-developable silver salt color diffusion transfer, heat developable multi-layer color diazo and silver salt color paper.

Of these, color paper is particularly preferred. The light-sensitive silver halide emulsions in the light-sensitive material each has a silver chloride content of at least 95 mol %, with the remaining being silver bromide, and preferably comprises a silver halide grain containing substantially no silver iodide. The term "contain substantially no silver iodide" as used herein means that the silver iodide content is 1 mol % or less, preferably 0.2 mol % or less, more preferably 0 mol %. In view of the rapid processing suitability, the silver halide emulsion preferably has a silver chloride content of 98 mol % or more. In particular, silver halide where a silver bromide localized phase is present on the surface of a silver chloride grain is more preferred because high sensitivity is obtained and stabilization of the photographic capability can be attained.

At least one light-sensitive silver halide emulsion layer preferably comprises a silver halide emulsion having a coefficient of variation in the grain size distribution (a value obtained by dividing the standard deviation of the grain size distribution by the average grain size) of 15% or less, and a monodisperse emulsion having a coefficient of variation in the grain size distribution of 10% or less is more preferred. Further, for the purpose of obtaining a wide latitude, two or more monodisperse emulsions are preferably mixed and used in the same layer. At this time, the mono-disperse emulsions are preferably different in the average grain size by 15% or more, more preferably by from 20 to 60%, still more preferably by 25 to 50%. The difference in the sensitivity between respective monodisperse emulsions is preferably from 0.15 to 0.50logE, more preferably from 0.20 to 0.40logE, still more preferably from 0.25 to 0.35logE.

For obtaining the objective image gradation of the present invention, it is effective to use a silver halide emulsion where an iron and/or ruthenium and/or an osmium compound is incorporated into silver chlorobromide containing substantially no silver iodide and having a silver chloride content of 95 mol % or more, in an amount of from $1\times10^{-5}$ to $1\times10^{-3}$ mol per mol of silver halide and the silver bromide localized phase contains an iridium compound in an amount of from $1\times10^{-7}$ to $1\times10^{-5}$ mol per mol of silver halide.

The output-purpose silver halide photographic light-sensitive material for use in the present invention may use conventionally known photographic materials and additives.

For example, the photographic support may be a transmission-type support or a reflection-type support. The transmission-type support is preferably a transparent film such as cellulose nitrate film and polyethylene terephthalate, more preferably a polyester of 2,6-naphthalenedicarboxylic acid (NDCA) with ethylene glycol (EG) or a polyester of NDCA, terephthalic acid and EG, having provided thereon an information recording layer such as a magnetic layer. From the standpoint of the object of the present invention, a reflection-type support is preferred and in particular, a reflective support comprising a laminate of a plurality of polyethylene layers or polyester layers with at least one of these water-proof resin layers (laminate layers) containing a white pigment such as titanium oxide is preferred.

The water-proof resin layer preferably contains a whitening agent. The whitening agent may also be dispersed in a hydrophilic colloid layer of the light-sensitive material. The whitening agent is preferably a benzoxazole-base, coumarin-base or pyrazoline-base whitening agent, more preferably a benzoxazolyl naphthalene-base or benzoxazolyl stilbene-base whitening agent. The amount used is not particularly limited, however, it is preferably from 1 to 100 $mg/m^2$. When the whitening agent is mixed with the water-proof resin, the mixing ratio is preferably from 0.0005 to 3 wt %, more preferably from 0.001 to 0.5 wt %, based on the resin. Further, a transparent support having provided thereon a hydrophilic colloid layer containing a white pigment may also be used.

Furthermore, the reflection-type support may be a support having a mirror reflective or second order diffusion reflective metal surface.

In order to render the image reproduction system of the present invention compact and inexpensive, a semiconductor laser or a second harmonic generation source (SHG) using a combination of a solid-state laser with a nonlinear optical crystal is preferably used. In particular, when a compact, cheap and highly stable device having a long life is intended, a semiconductor laser is preferably used and at least one of the light sources for exposure is preferably a semiconductor laser.

When such a light source for scanning exposure is used, the spectral sensitivity maximum wavelength of the output-purpose color light-sensitive material may be freely selected according to the wavelength of the light source for scanning exposure used. In the case of the solid-state laser using a semiconductor laser as an excitation light source or the SHG light source using a combination of a semiconductor laser with a nonlinear optical crystal, the oscillation wavelength of the laser can be made half and accordingly, a blue light and a green light can be obtained. As a result, the light-sensitive material can have a spectral sensitivity maximum in normal three wavelength regions of blue, green and red.

When the exposure time in the scanning exposure is defined as the time required for exposing a picture element having a size such that the picture element density is 400 dpi, the exposure time is preferably $10^{-4}$ second or less, more preferably $10^{-6}$ second or less.

4. Color Photographic Material for Photographing, to Which the Present Invention is Applied The color photographic material for photographing for use in the present invention is preferably a color negative film.

As described above, the color negative film for use in the present invention may be a general-purpose commercially available color negative film produced by respective manufacturers.

The photographic material for photographing for use in the present invention may be a color negative film. A representative example of the color negative film is a multilayered photographic light-sensitive material comprising a transparent support (for example, a plastic film such as TAC and PEN) having provided thereon a silver halide emulsion (for example, silver iodobromide and silver iodochloride) comprising silver iodide, for example, in an amount of from 3 to 12 mole %. A typical example of the color negative film is a photographic light-sensitive material comprising a support having provided thereon an antihalation layer, two or three red-sensitive layers different in the sensitivity, two or three green-sensitive layers different in the sensitivity, a yellow filter layer, two or three blue-sensitive layers different in the sensitivity, and a protective layer, in this order. A total thickness of hydrophilic colloid layers represented by the above-described constitution layers is generally from 16 to 25 $\mu$m. A tabular emulsion is usually used as the silver halide emulsion. The silver coverage is usually from about 3 to about 6 g per unit square meter.

A typical example of the color negative film for use in the present invention is a silver halide photographic light-sensitive material comprising a support having thereon at least one light-sensitive layer comprising a plurality of silver halide emulsion layers substantially the same in the spectral sensitivity but different in the sensitivity. The light-sensitive layer is a unit light-sensitive layer having spectral sensitivity to any one of blue light, green light and red light. In the case of a multi-layer silver halide color photographic light-sensitive material, the unit light-sensitive layers are generally arranged such that a red-sensitive layer, a green-sensitive layer and a blue-sensitive layer are provided in this order from the support side. However, the above-described arrangement order may be reversed depending on the purpose or a layer having different sensitivity may be interposed between layers having the same spectral sensitivity. Also, a light-insensitive layer may be provided between silver halide light-sensitive layers or as an uppermost or lowermost layer. These layers may contain a coupler, a DIR compound or a color mixing inhibitor which will be described later. The silver halide emulsion layers in a plurality constituting each unit light-sensitive layer are preferably arranged such that two layers of a high-sensitivity emulsion layer and a low-sensitivity emulsion layer are provided so that the sensitivity decreases in sequence towards the support as described in German Patent 1,121,470 and British Patent 923,045. Further, a low-sensitivity emulsion layer may be provided farther from the support and a high-sensitivity emulsion layer may be provided closer to the support as described in JP-A-57-112751, JP-A-62-200350, JP-A-62-206541 and JP-A-62-206543.

Specific examples of the layer arrangement include from the farthest side from the support, an order of a low-sensitivity blue-sensitive layer (BL)/a high-sensitivity blue-sensitive layer (BH)/a high-sensitivity green-sensitive layer (GH)/a low-sensitivity green-sensitive layer (GL)/a high-sensitivity red-sensitive layer (RH)/a low-sensitivity red-sensitive layer (RL), an order of BH/BL/GL/GH/RH/RL and an order of BH/BL/GH/GL/RL/RH. Also, as described in JP-B-55-34932, a blue-sensitive layer/GH/RH/GL/RL may be provided in this order from the farthest side from the support. Further, as described in JP-A-56-25738 and JP-A-62-63936, a blue-sensitive layer/GL/RL/GH/RH may be provided in this order from the farthest side from the support. Furthermore, a three-layer structure may be used as described in JP-B-49-15495, where a silver halide emulsion layer having highest sensitivity is provided as an upper layer, a silver halide emulsion layer having sensitivity lower than that of the upper layer is provided as a middle layer and a silver halide emulsion layer having sensitivity lower than that of the middle layer is provided as a lower layer so that the sensitivity decreases in sequence towards the support. Even in the case of the construction comprising three layers different in the sensitivity, a middle-sensitivity emulsion layer/a high-sensitivity emulsion layer/a low-sensitivity emulsion layer may be provided in this order from the side farther from the support within the same spectral sensitive layers as described in JP-A-59-202464. In addition, an order of a high-sensitivity emulsion layer/a low-sensitivity emulsion layer/a middle-sensitivity emulsion layer or an order of a low-sensitivity emulsion layer/a middle-sensitivity emulsion layer/a high-sensitivity emulsion layer may also be used. Also when four or more layers are provided, the layer arrangement may be varied as described above. In order to improve the color reproducibility, a donor layer (CL) having an interimage effect and having a spectral sensitivity distribution different from the main light-sensitive layers such as BL, GL and RL is preferably provided adjacent to or in the vicinity of the main light-sensitive layers as described in U.S. Pat. Nos. 4,663,271, 4,705,744 and 4,707,436, JP-A-62-160448 and JP-A-63-89850.

The silver halide preferably used in the present invention is silver iodobromide, silver iodochloride or silver iodochlorobromide having a silver iodide content of about 30 mol % or less, more preferably silver iodobromide or silver iodochlorobromide having a silver iodide content of from about 2 to about 10 mol %. The silver halide grain in the photographic emulsion may have a regular crystal form such as cubic, octahedral or tetradecahedral form, an irregular crystal form such as spherical or platy form, a crystal defect such as twin, or a composite form thereof. The silver halide grain may be a fine grain having a grain size of about 0.2 $\mu$m or less or a large-sized grain having a grain size in terms of the projected area diameter up to about 10 $\mu$m. Further, either a polydisperse emulsion or a monodisperse emulsion may be used. The silver halide photographic emulsion which can be used in the present invention can be prepared according to the method described, for example, in *Research Disclosure* (hereinafter simply referred to as "RD") No. 17643, pp. 22–23, "I. Emulsion Preparation and Types" (December, 1978), ibid., No. 18716, p. 648 (November, 1979), ibid., No. 307105, pp. 863–865 (November, 1989), P. Glafkides, *Chemie et Phisique Photographique*, Paul Montel (1967), G. F. Duffin, *Photographic Emulsion Chemistry*, The Focal Press (1966), and V.L. Zelikman et al., *Making and Coating Photographic Emulsion*, The Focal Press (1964).

Monodisperse emulsions described in U.S. Patents 3,574,628 and 3,655,394 and British Patent 1,413,748 are also preferred. Tabular grains having an aspect ratio of about 3 or more can also be used in the present invention. Tabular grains can be easily prepared by the method described in Gutoff, *Photographic Science and Engineering*, Vol. 14, pp. 248–257 (1970), U.S. Pat. Nos. 4,434,226, 4,414,310, 4,433,048 and 4,439,520 and British Patent 2,112,157.

The silver halide emulsion is usually subjected to physical ripening, chemical ripening and spectral sensitization before use. The additives used in these steps are described in RD Nos. 17643, 18716 and 307105, and the pertinent portions thereof are summarized in the table below. In the light-sensitive material of the present invention, two or more kinds of emulsions different at least in one property of grain size, grain size distribution, halogen composition, grain from and sensitivity of the light-sensitive silver halide emulsion can be mixed and used in the same layer. A silver halide grain with the grain surface being fogged described in U.S. Pat. No. 4,082,553, a silver halide grain with the inside of the grain being fogged described in U.S. Pat. No. 4,626,498 and JP-A-59-214852, or colloidal silver may be used in a light-sensitive silver halide emulsion layer and/or a substantially light-insensitive hydrophilic colloidal layer depending on the purpose. The silver halide grain with the inside or surface of the grain being fogged means a silver halide grain capable of uniform (namely, non-imagewise) development irrespective of unexposed area and exposed area of the photographic material. The preparation method thereof is described in U.S. Pat. No. 4,626,498 and JP-A-59-214852. The silver halide forming the internal nucleus of a core/shell type silver halide grain with the inside of the grain being fogged may have a different halide composition. The silver halide for a grain with the inside or surface thereof being fogged may be any of silver chloride, silver chlorobromide, silver iodobromide and silver chloroiodobromide. The fogged silver halide grain preferably has an average grain size of from 0.01 to 0.75 $\mu$m, more preferably from 0.05 to 0.6 $\mu$m.

The color negative film for use in the present invention may also use a light-insensitive fine grain silver halide. The term "light-insensitive fine grain silver halide" as used herein means a silver halide fine grain which is not sensitive to light at the time of imagewise exposure for obtaining a dye image and substantially not developed at the time of development processing. The light-insensitive fine grain silver halide is preferably not fogged previously. The fine grain silver halide has a silver bromide content of from 0 to 100 mol % and may contain, if desired, silver chloride and/or silver iodide. It preferably contains from 0.5 to 10 mol % of silver iodide. The fine grain silver halide has an average grain size (an average of equivalent-circle diameters of the projected area) of preferably from 0.01 to 0.5 $\mu$m, more preferably from 0.02 to 0.2 $\mu$m. The fine grain silver halide can be prepared by the same method as the preparation method of normal light-sensitive silver halide.

The photographic additives which can be used in the negative film for use in the present invention are also described in RDs and the portions having the pertinent description are shown in Table 1 below.

TABLE 1

| | Kinds of Additives | RD17643 | RD18716 | RD307105 |
|---|---|---|---|---|
| 1. | Chemical sensitizer | p. 23 | p. 648, right col. | p. 866 |
| 2. | Sensitivity increasing agent | | p. 648, right col. | |
| 3. | Spectral sensitizer, supersensitizer | pp. 23–24 | p. 648, right col.-p.649, right col. | pp. 866–868 |
| 4. | Whitening agent | p. 24 | p. 647, right col. | p. 868 |
| 5. | Light absorbent, filter dye, UV absorbent | pp. 25–26 | p. 649, right col.-p. 650, left col. | p. 873 |
| 6. | Binder | p. 26 | p. 651, left col. | pp. 873–874 |
| 7. | Plasticizer, lubricant | p. 27 | p. 650, right col. | p. 876 |
| 8. | Coating aid, surface active agent | pp. 26–27 | p. 650, right col. | pp. 875–876 |
| 9. | Antistatic agent | p. 27 | p. 650, right col. | pp. 876–877 |
| 10. | Matting agent | | | pp. 878–879 |

Various dye-forming couplers can be used in the color negative film for use in the present invention and the following couplers are particularly preferred.

Yellow Coupler:

Couplers represented by formula (I) or (II) of EP-A-502424; couplers represented by formula (1) or (2) (particularly, Y-28 at page 18) of EP-A-513496; couplers represented by formula (I) in claim 1 of EP-A-568037; couplers represented by formula (I) in column 1, lines 45 to 55 of U.S. Pat. No. 5,066,576; couplers represented by formula (I) in paragraph 0008 of JP-A-4-274425; couplers (particularly, D-35 at page 18) described in claim 1 at page 40 of EP-A-498381; couplers represented by formula (Y) at page 4 (particularly, Y-1 (page 17) and Y-54 (page 41)) of EP-A-447969; couplers represented by formula (II), (III) or (IV) in column 7, lines 36 to 58 (particularly, II-17, II-19 (column 17) and II-24 (column 19)) of U.S. Pat. No. 4,476,219;

Magenta Coupler:

Compounds L-57 (page 11, right lower column), L-68 (page 12, right lower column) and L-77 (page 13, right lower column) of JP-A-3-39737; Compounds A-4-63 (page 134), A-4-73 and A-4-75 (page 139) of EP-A-456257; Compounds M-4, M-6 (page 26) and M-7 (page 27) of EP-A-486965; Compound M-45 (page 19) of EP-A-571959; Compound M-1 (page 6) of JP-A-5-204106; Compound M-22 in paragraph 0237 of JP-A-4-362631;

Cyan Coupler:

Compounds CX-1, CX-3, CX-4, CX-5, CX-11, CX-12, CX-14 and CX-15 (pages 14 to 16) of JP-A-4-204843; Compounds C-7, C-10 (page 35), C-34, C-35 (page 37), (I-1) and (I-17) (pages 42 and 43) of JP-A-4-43345; couplers represented by formula (Ia) or (Ib) in claim 1 of JP-A-6-67385; and Polymer Coupler:

Compounds P-1 and P-5 (page 11) of JP-A-2-44345.

Preferred examples of the coupler which provides a colored dye having an appropriate diffusibility include those described in U.S. Pat. No. 4,366,237, British Patent 2,125,570, EP-B-96873 and German Patent 3,234,533. Preferred examples of the coupler for correcting unnecessary absorption of a colored dye include yellow colored cyan couplers represented by formula (CI), (CII), (CIII) or (CIV) described at page 5 of EP-A-456257 (particularly, Compound YC-86 at page 84); Yellow Colored Magenta Couplers ExM-7 (page 202), EX-1 (page 249) and EX-7 (page 251) described in EP-A-456257; Magenta Colored Cyan Couplers CC-9 (column 8) and CC-13 (column 10) described in U.S. Pat. No. 4,833,069; and colorless masking couplers represented by formula (2) (column 8) of U.S. Pat. No. 4,837,136 or formula (A) in claim 1 of WO92/11575 (particularly, compounds described at pages 36 to 45). Examples of the compound (including coupler) which releases a photographically useful compound residue upon reaction with an oxidation product of the developing agent include the following:

Development Inhibitor-releasing Compound:

Compounds represented by formula (I), (II), (III) or (IV) described at page 11 of EP-A-378236 (particularly, T-101 (page 30), T-104 (page 31), T-113 (page 36), T-131 (page 45), T-144 (page 51) and T-158 (page 58)); compounds represented by formula (I) described at page 7 of EP-A-436938 (particularly, D-49 (page 51)); compounds represented by formula (1) of EP-A-568037 (particularly, Compound (23) at page 11); and compounds represented by formula (I), (II) or (III) described at pages 5 and 6 of EP-A-440195 (particularly, Compound I-(1) at page 29);

Bleaching Accelerator-releasing Compound:

Compounds represented by formula (I) or (I') at page 5 of EP-A-310125 (particularly Compounds (60) and (61) at page 61); and compounds represented by formula (I) in claim 1 of JP-A-6-59411 (particularly, Compound (7) at page 7);

Ligand-releasing Compound:

Compounds represented by LIG-X described in claim 1 of U.S. Pat. No. 4,555,478 (particularly, compounds in column 12, lines 21 to 41);

Leuco Dye-releasing Compound:

Compounds 1 to 6 in columns 3 to 8 of U.S. Pat. No. 4,749,641;

Fluorescent Dye-releasing Compound:

Compounds represented by COUP-DYE in claim 1 of U.S. Pat. No. 4,774,181 (particularly, Compounds 1 to 11 in columns 7 to 10);

Development Accelerator- or Fogging Agent-releasing Compound:

Compounds represented by formula (1), (2) or (3) in column 3 of U.S. Pat. No. 4,656,123 (particularly Compound (I-22) in column 25) and Compound ExZK-2 at page 75, lines 36 to 38 of EP-A-450637;

Compound Which Releases a Group Capable of Becoming Dye First When Released:

Compounds represented by formula (I) in claim 1 of U.S. Pat. No. 4,857,447 (particularly, Compounds Y-1 to Y-19 in columns 25 to 36).

Preferred additives other than couplers are described below.

Dispersion Medium of Oil-soluble Organic Compound:

Compounds P-3, P-5, P-16, P-19, P-25, P-30, P-42, P-49, P-54, P-55, P-66, P-81, P-85, P-86 and P-93 of JP-A-62-215272 (pages 140 to 144);

Latex for Impregnation of Oil-soluble Organic Compound:

Latexes described in U.S. Pat. No. 4,199,363;

Developing Agent Oxidation Product Scavenger:

Compounds represented by formula (I) in column 2, lines 54 to 62 of U.S. Pat. No. 4,978,606 (particularly, Compounds I-(1), I-(2), I-(6) and I-(12) (columns 4 to 5)) and compounds represented by any one of the formulae in column 2, lines 5 to 10 of U.S. Pat. No. 4,923,787 (particularly, Compound 1 (column 3));

Stain Inhibitor:

Compounds represented by formula (I), (II) or (III) at page 4, lines 30 to 33 of EP-A-298321 (particularly, Compounds I-47, I-72, III-1 and III-27 (pages 24 to 48));

Discoloration Inhibitor:

Compounds A-6, A-7, A-20, A-21, A-23, A-24, A-25, A-26, A-30, A-37, A-40, A-42, A-48, A-63, A-90, A-92, A-94 and A-164 of EP-A-298321 (pages 69 to 118), Compounds II-1 to III-23 in columns 25 to 38 of U.S. Pat. No. 5,122,444 (particularly, Compound III-10), Compounds I-1 to III-4 at pages 8 to 12 of EP-A-471347 (particularly, Compound II-2) and Compounds A-1 to A-48 in columns 32 to 40 of U.S. Pat. No. 5,139,931 (particularly, Compounds A-39 and A-42);

Material Which Reduces Use Amount of Coloration Reinforcing Agent or Color Mixing Inhibitor:

Compounds I-1 to II-15 at pages 5 to 24 of EP-A-411324 (particularly, Compound I-46);

Formalin Scavenger:

Compounds SCV-1 to SCV-28 at pages 24 to 29 of EP-A-477932 (particularly Compound SCV-8);

Hardening Agent:

Compounds H-1, H-4, H-6, H-8 and H-14 at page 17 of JP-A-1-214845, compounds (Compounds H-1 to H-54) represented by any one of formulae (VII) to (XII) in columns 13 to 23 of U.S. Pat. No. 4,618,573, compounds (Compounds H-1 to H-76) represented by formula (6) at page 8, right lower column of JP-A-2-214852 (particularly, Compound H-14) and compounds described in claim 1 of U.S. Pat. No. 3,325,287;

Development Inhibitor Precursor:

Compounds P-24, P-37 and P-39 of JP-A-62-168139 (pages 6 and 7) and compounds described in claim 1 of U.S. Pat. No. 5,019,492 (particularly, Compounds 28 and 29 in column 7);

Antiseptic, Antifungal:

Compounds I-1 to III-43 in columns 3 to 15 of U.S. Pat. No. 4,923,790 (particularly, Compounds II-1, II-9, II-10, II-18 and III-25);

Stabilizer, Antifoggant:

Compounds I-1 to (14) in columns 6 to 16 of U.S. Pat. No. 4,923,793 (particularly, Compounds I-1, I-60, (2) and (13)) and Compounds 1 to 65 in columns 25 to 32 of U.S. Pat. No. 4,952,483 (particularly, Compound 36);

Chemical Sensitizer:

Triphenylphosphine, selenide and Compound 50 of JP-A-5-40324;

Dye:

Compounds a-1 to b-20 at pages 15 to 18 (particularly, Compounds a-1, a-12, a-18, a-27, a-35, a-36 and b-5) and Compounds V-1 to V-23 at pages 27 to 29 (particularly, Compound V-1) of JP-A-3-156450, Compounds F-I-1 to F-II-43 at pages 33 to 55 of EP-A-445627 (particularly, Compounds F-I-11 and F-II-8), Compounds III-1 to III-36 at pages 17 to 28 of EP-A-457153 (particularly, Compounds III-1 and III-3), fine crystal dispersion products of Dye-1 to Dye-124 at pages 8 to 26 of WO88/04794, Compounds 1 to 22 at pages 6 to 11 of EP-A-319999 (particularly, Compound 1), Compounds D-1 to D-87 (pages 3 to 28) represented by formula (1), (2) or (3) of EP-A-519306, Compounds 1 to 22 (columns 3 to 10) represented by formula (I) of U.S. Pat. No. 4,268,622 and Compounds (1) to (31) (columns 2 to 9) represented by formula (I) of U.S. Pat. No. 4,923,788;

UV Absorbent:

Compounds (18b) to (18r) and Compounds 101 to 427 (pages 6 to 9) represented by formula (1) of JP-A-46-3335, Compounds (3) to (66) (pages 10 to 44) represented by formula (I) and Compounds HBT-1 to HBT-10 (page 14) represented by formula (III), of EP-A-520938, and Compounds (1) to (31) (columns 2 to 9) represented by formula (1) of EP-A-521823.

The color negative film of the present invention may be a film unit with a lens described in JP-B-2-32615 and JP-B-U-3-39784 (the term "JP-B-U" as used herein means an "examined Japanese utility model publication"). Examples of suitable supports which can be used in the present invention include those described in RD, No. 17643, page 28, ibid., No. 18716, from page 647, right column to page 648, left column, and ibid., No. 307105, page 879, but a polyester support is preferably used.

The color negative film for use in the present invention preferably has a magnetic recording layer. The magnetic recording layer for use in the present invention is descried below. The magnetic recording layer used in the present invention is provided by coating an aqueous or organic solvent-base coating solution prepared by dispersing magnetic particles in a binder, on a support. The magnetic particle includes ferromagnetic iron oxide (e.g., $\gamma Fe_2O_3$), Co-doped $\gamma Fe_2O_3$, Co-doped magnetite, Co-containing magnetite, ferromagnetic chromium dioxide, ferromagnetic metal, ferromagnetic alloy, hexagonal Ba ferrite, Sr ferrite, Pb ferrite and Ca ferrite. Among these, Co-doped ferromagnetic iron oxide such as Co-doped $\gamma Fe_2O_3$ is preferred. The form of the magnetic particle may be any of acicular, rice grain-like, spherical, cubic and platy forms. The specific surface area as $S_{BET}$ is preferably 20 $m^2/g$ or more, more preferably 30 $m^2/g$ or more. The saturation magnetization (as) of the ferromagnetic material is preferably from $3.0\times10^4$ to $3.0\times10^5$ A/m, more preferably from $4.0\times10^4$ to $2.5\times10^5$ A/m. The ferromagnetic particle may be subjected to surface treatment with silica and/or alumina or an organic material. Further, the ferromagnetic particle may be subjected to surface treatment with a silane coupling agent or a titanium coupling agent as described in JP-A-6-161032. Also, a magnetic particle having coated on the surface thereof an inorganic or organic material described in JP-A-4-259911 and JP-A-5-81652 may be used.

The binder for use in the magnetic particle includes a thermoplastic resin, a thermosetting resin, a radiation-curable resin, a reactive resin, an acid, alkali or biodegradable polymer, a natural polymer (e.g., cellulose derivative, saccharide derivative) and a mixture thereof described in JP-A-4-219569. The above-described resin has a Tg of from −40° C. to 300° C. and a weight average molecular weight of from 2,000 to 1,000,000. Examples of the resin include vinyl-base copolymers, cellulose compounds such as cellulose diacetate, cellulose triacetate, cellulose acetate propionate, cellulose acetate butyrate and cellulose tripropionate, acrylic resins and polyvinyl acetal resins, and gelatin is also preferably used. Among these, cellulose di(tri)acetate is preferred. The binder may be cured by adding thereto an epoxy-base, aziridine-base or isocyanate-base cross-linking agent. Examples of the isocyanate-base cross-linking agent include isocyanates such as tolylene diisocyanate, 4,4'-diphenylmethane diisocyanate, hexamethylene diisocyanate and xylylene diisocyanate, reaction products of this isocyanate with polyalcohol (e.g., a reaction product of 3 mol of tolylene diisocyanate with 1 mol of trimethylolpropane), and polyisocyanates produced by condensation of the isocyanate, which are described, for example, in JP-A-6-59357.

The magnetic recording layer may be designed to have additional functions such as improvement of lubricity, control of curl, electrostatic charge prevention, prevention of adhesion or head abrasion, or other functional layers may be provided to undertake these functions. At least one or more of the particles is preferably an abrasive as an aspheric inorganic particle having a Mohs' hardness of 5 or more. The composition of the aspheric inorganic particle is preferably an oxide such as aluminum oxide, chromium oxide, silicon dioxide or titanium dioxide, a carbide such as silicon carbide or titanium carbide, or a fine particle of diamond or the like. The abrasive may be subjected to surface treatment with a silane coupling agent or a titanium coupling agent. The particles may be added to a magnetic recording layer or may be overcoated on the magnetic recording layer (for example, as a protective layer or a lubricant layer). The binder used here may be one described above and it is preferably the same as the binder in the magnetic recording layer. The light-sensitive material having a magnetic recording layer is described in U.S. Pat. Nos. 5,336,589, 5,250,404, 5,229,259 and 5,215,874 and EP-A-466130.

The polyester support for use in the present invention is described below, however, the details thereof including the light-sensitive material, the processing, the cartridge and the working examples are described in *JIII Journal of Technical Disclosure* No. 94-6023, Japan Institute of Invention and Innovation (Mar. 15, 1994). The polyester for use in the present invention essentially consists of a diol and an aromatic dicarboxylic acid. Examples of the aromatic dicarboxylic acid include 2,6-naphthalenedicarboxylic acid, 1,5-naphthalenedicarboxylic acid, 1,4-naphthalenedicarboxylic acid, 2,7-naphthalenedicarboxylic acid, terephthalic acid, isophthalic acid and phthalic acid, and examples of the diol include diethylene glycol, triethylene glycol, cyclohexanedimethanol, bisphenol A and bisphenol. The polymer polymerized from these includes homopolymers such as polyethylene terephthalate, polyethylene naphthalate and polycyclohexanedimethanol terephthalate. Among these, preferred is a polyester containing from 50 to 100 mol % of 2,6-naphthalenedicarboxylic acid, and more preferred is polyethylene 2,6-naphthalate. The average molecular weight is from about 5,000 to 200,000. The polyester for use in the present invention has a Tg of 50° C. or higher, preferably 90° C. or higher.

In the present invention, an antistatic agent is preferably used. Examples of the antistatic agent includes polymers containing a carboxylic acid, a carboxylate or a polymer having a sulfonate, cationic polymers and ionic surface active agent compounds. Most preferred antistatic agents are fine particles of at least one crystalline metal oxide having a volume resistivity of 107 Ω·cm or less, preferably 105 Ω·cm or less and a particle size of from 0.001 to 1.0 μm, selected from ZnO, $TiO_2$, $SnO_2$, $Al_2O_3$, $In_2O_3$, $SiO_2$, MgO, BaO, $MoO_3$ and $V_2O_5$, or a composite oxide thereof (e.g., Sb, P, B, In, S, Si, C), and fine particles of a sol-like metal oxide or a composite oxide thereof. The content of the antistatic agent in the light-sensitive material is preferably from 5 to 500 mg/m$^2$, more preferably from 10 to 350 mg/m$^2$. The ratio of the electrically conductive crystalline oxide or a composite oxide thereof to the binder is preferably from 1/300 to 100/1, more preferably from 1/100 to 100/5.

The light-sensitive material of the present invention preferably has sliding property. The sliding agent-containing layer is preferably provided on both the light-sensitive layer surface and the back surface. The sliding property is preferably, in terms of a coefficient of dynamic friction, from 0.01 to 0.25. This value is determined by transporting the light-sensitive material at a speed of 60 cm/min (25° C., 60% RH) against a stainless steel ball having a diameter of 5 mm. In this evaluation, even when the other party is changed from the back surface to the light-sensitive layer surface, a value almost on the same level is obtained. The sliding agent which can be used in the present invention includes polyorganosiloxane, a higher fatty acid amide, a higher fatty acid metal salt and an ester of a higher fatty acid with a higher alcohol. The layer to which the sliding agent is added is preferably an outermost layer of the emulsion layers or a back layer.

The present invention is described below in greater detail with reference to the Examples, however, the present invention should not be construed as being limited thereto.

EXAMPLES AND COMPARATIVE EXAMPLES

The light-sensitive material, the development processing machine and the matters for implementation used are described.

1. Color Negative Film Tested:

As a representative for the general-purpose color negative film, a color negative film the same as Sample 101 described in Example 1 of JP-A-8-339063 (corresponding to EP-A-0750226) was used in the form of 135-24Ex (normal 35 mm, 24 frames in a patrone) according to the ISO1007 standard. This film had an ISO sensitivity of 400.

2. Method of Testing Photographic Properties:

A person and a Macbeth chart were photographed on each test film with the standard exposure amount under illumination of a standard C light source described in ISO5800 (Measurement Method of Sensitivity of Color Negative Film). The development conditions were changed as follows and the properties of the photographic image reproduced were visually judged.

3. Development Processing Machine Used:

The picture processing device as described above as an embodiment at the item of image reproduction according to the present invention was used in combination with a color negative film development processing machine (FP560B, manufactured by Fuji Photo Film Co., Ltd.), except that the other development processing machine was used for Comparative Examples. However, the driving motor was modified so that the transportation rate of the film could be varied.

4. Development Processing:

The processing steps and processing solution compositions used as the basic development processing for color negative film are shown below.

(Processing Step)

| Step | Processing Time | Processing Temperature (° C.) |
|---|---|---|
| Color Development | 3 min. 5 sec. | 38.0 |
| Bleaching | 50 sec. | 38.0 |
| Fixing (1) | 50 sec. | 38.0 |
| Fixing (2) | 50 sec. | 38.0 |
| Water washing | 30 sec. | 38.0 |
| Stabilization (1) | 20 sec. | 38.0 |
| Stabilization (2) | 20 sec. | 38.0 |
| Drying | 1 min. 30 sec. | 60 |

The stabilizing solution was run in a co-current system from (2) to (1). The overflow solution of the washing water all was introduced into the fixing (2). The fixing solution was also run through a co-current piping connected from (2) to (1). The amount of the developer carried over to the bleaching step, the amount of the bleaching solution carried over to the fixing step and the amount of the fixing solution carried over to the water washing step were 2.5 ml, 2.0 ml and 2.0 ml, respectively, per 1.1 m of the 35 mm-width light-sensitive material. Each cross-over time was 6 seconds and this time is included in the processing time of the previous step.

The composition of each processing solution is shown below.

(Color Developer A)

| | Tank Solution (g) |
|---|---|
| Diethylenetriaminepentaacetic acid | 2.0 |
| 1-Hydroxyethylidene-1,1-diphosphonic acid | 2.0 |
| Sodium sulfite | 3.9 |
| Potassium carbonate | 37.5 |
| Potassium bromide | 0.012 mol |
| Potassium iodide | 1.3 mg |
| Disodium N,N-bis(sulfonatoethyl)-hydroxylamine | 2.0 |
| Hydroxylamine sulfate | 2.4 |
| 2-Methyl-4-[N-ethyl-N-(β-hydroxyethyl)-amino]aniline sulfate (color developing agent) | 0.0145 mol |
| Water to make | 1.0 l |
| pH (adjusted with potassium hydroxide and sulfuric acid) | 10.05 |
| (Bleaching Solution) | |
| Ammonium 1,3-diaminopropanetetraacetato ferrate monohydrate | 118 |
| Ammonium bromide | 80 |
| Ammonium nitrate | 14 |
| Succinic acid | 40 |
| Maleic acid | 33 |
| Water to make | 1.0 l |
| pH (adjusted with aqueous ammonia) | 4.4 |
| (Fixing Solution) | |
| Ammonium methanesulfonate | 10 |
| Ammonium methanethiosulfonate | 4 |
| Aqueous solution of ammonium thiosulfate (700 g/l) | 280 ml |
| Imidazole | 7 |
| Ethylenediaminetetraacetic acid | 15 |
| Water to make | 1.0 l |
| pH (adjusted with aqueous ammonia and acetic acid) | 7.4 |
| (Washing Water) | |

Tap water was passed through a mixed bed column filled with an H-type strongly acidic cation exchange resin (Amberlite IR-120B, produced by Rhom & Haas) and an OH-type anion exchange resin (Amberlite IR-400, produced by the same company) to reduce the calcium and magnesium ion concentrations each to 3 mg/liter or less and then thereto 20 mg/Q of dichlorinated sodium isocyanurate and 150 mg/liter of sodium sulfate were added. The resulting solution had a pH of from 6.5 to 7.5.

(Stabilizing Solution)

| | Tank Solution (g) |
|---|---|
| Sodium p-toluenesulfinate | 0.03 |
| Polyoxyethylene-p-monononylphenyl ether (average polymerization degree: 10) | 0.2 |
| Disodium ethylenediaminetetraacetate | 0.05 |
| 1,2,4-Triazole | 1.3 |
| 1,4-Bis(1,2,4-triazol-1-ylmethyl)piperazine | 0.75 |
| 1,2-Benzoisothiazolin-3-one | 0.10 |
| Water to make | 1.0 l |
| pH | 8.5 |

Color Development Conditions B to H were prepared by changing the above-described composition of the color developer, processing steps, processing time and processing temperature (the combination of the conditions being designated as "Color Development Condition A") as shown in Table 2 follows.

TABLE 2

Color Development Conditions

| Color Development Condition | Developing Agent (M) | KBr (M) | Temperature (° C.) | Time (min · sec) |
|---|---|---|---|---|
| A | 0.0145 | 0.012 | 38 | 3' 05" |
| B | 0.030 | 0.012 | 38 | 2' 00" |
| C | 0.0145 | 0.030 | 42 | 3' 05" |
| D | 0.0145 | 0.030 | 45 | 1' 30" |
| E | 0.035 | 0.030 | 45 | 1' 00" |
| F | 0.010 | 0.012 | 38 | 6' 00" |
| G | 0.010 | 0.012 | 45 | 3' 05" |
| H | 0.060 | 0.040 | 50 | 50" |

Note: A to H indicate Color Developers A to H and at the same time, Color Development Conditions A to H.

The color negative film photographed above was subjected to the development processing under respective color development conditions shown above and then to printing on a color paper.

5. Output Device

Laser Printer/Paper Processor LP-1000P (manufactured by Fuji Photo Film Co., Ltd.) was used as one example of commercially available printers which can take in the electrical image signal taken out from FP560B and make a positive image.

For comparative samples, a commercially available apparatus, Color Printer/Paper Processor PP728A (Fuji Mini-Labo Champion, manufactured by Fuji Photo Film Co., Ltd.) using non-scanning area-wise exposure system, was used. The printer of this apparatus employs the method commonly used at present on the market, namely, the entire surface simultaneous exposing method where printing on a color paper is performed by the transmission through the developed color negative film and the color balance is controlled by a filter.

The color paper used in all the development conditions was a commercially available Fuji Color Paper Super FA3

(produced by Fuji Photo Film Co., Ltd.) and the development processing was performed according to the general-purpose CP47L Formulation (development processing formulation and processing agents for color paper, produced by Fuji Photo Film Co., Ltd.).

6. Tests

Following tests were performed.

(1) Sensory Evaluation of Image Quality

Color negative films processed with Color Developers A to H each was subjected to printing by LP1000 or printing by PP728A.

The printed image was sensorially evaluated by 10 panellers randomly selected and each paneller made scoring by the five stage rating of from 1 to 5.

| | |
|---|---|
| Poor: | 1 point |
| Slightly poor: | 2 points |
| Fair (the same level as the print quality familiar in usual): | 3 points |
| Fairly good: | 4 points |
| Good: | 5 points |

An average of the points obtained was determined.

(2) Evaluation of Graininess and Sharpness

The same observer visually evaluated the same print similarly by the five stage rating as described above while taking notice of the edge sharpness at the outline part of a personal image and the graininess of the skin.

7. Test Results

The test results of the sensory evaluations of image quality are shown in Table 3 below.

TABLE 3

| Color Development Condition | Picture Processed Print (LP1000) | Normal Non-scanning Area-wise Exposure Print (PP728A) |
|---|---|---|
| A | 3.8 | 3.5 |
| B | 4.5* | 3.4 |
| C | 4.1* | 3.3 |
| D | 4.2* | 3.4 |
| E | 4.6* | 3.3 |
| F | 3.8 | 3.4 |
| G | 4.2* | 3.4 |
| H | 4.8* | 3.3 |

Note: *Present invention
Others are Comparative Examples.

Prints obtained through digital picture processing gained higher evaluation points with respect to the image quality than the prints obtained through normal non-scanning area-wise exposure, however, the prints processed according to the present invention gained further higher evaluation points. In particular, the effect is remarkable in Conditions B, E and H using a high developing agent concentration.

It is apparent from these results that when the development processing is performed using a high developing agent concentration, a high bromide ion concentration, a high-temperature development, or a short-period development individually or in combination and the image obtained is printed through the picture processing, the image quality is improved.

The test results of the visual evaluation of the. graininess and sharpness are shown in Table 4 below. The finer (better) the graininess is, the higher the evaluation point is.

TABLE 4

| Color Development | Picture Processed Print (LP1000) | | Normal Non-scanning Area-wise Exposure Print (PP728A) | |
|---|---|---|---|---|
| Condition | graininess | sharpness | graininess | sharpness |
| A | 3.4 | 3.5 | 3.5 | 3.5 |
| B | 3.8* | 3.6* | 3.8 | 3.1 |
| C | 4.1* | 3.5* | 3.5 | 3.0 |
| D | 3.9* | 3.6* | 3.6 | 3.1 |
| E | 4.1* | 3.6* | 3.8 | 3.1 |
| F | 3.5 | 3.5 | 3.1 | 3.3 |
| G | 3.9* | 3.7* | 3.7 | 3.0 |
| H | 4.1* | 3.5* | 3.8 | 3.1 |

Note: *Present invention
Others are Comparative Examples.

The prints obtained by performing the development processing under Color Development Conditions B to E, G and H according to the present invention and then performing the picture processing according to the present invention (those marked with * in Tables 3 and 4) are superior in both the sharpness and the graininess as compared with the prints obtained through the normal non-scanning area-wise exposure. On the other hand, the prints obtained by performing the development processing under Color Development Conditions B to E, G and H according to the present invention but then performing the image reproduction through the normal non-scanning area-wise exposure show good graininess but show reduced sharpness as compared with the prints obtained by performing the development processing under Color Development Condition A for comparison. Similarly, the print obtained by performing the development processing under Color Development Condition F for comparison is not observed to be improved in the sharpness and graininess. From these results, it is apparent that when the development processing is performed using a high developing agent concentration, high bromide ion concentration, a high-temperature development, or a short-period development individually or in combination and the image obtained is printed through the picture processing, both the graininess and the sharpness are improved.

According to the image formation method comprising color-developing a photographed color light-sensitive material under one or more conditions of high developing agent concentration, high bromide ion concentration, high-temperature development, and a short-period development, picture-processing the image obtained and taking out the image information to a positive material, the sharpness and the graininess both can be improved, which have been difficult to attain in the conventional method of forming a positive material by the non-scanning area-wise exposure without passing through the picture processing. The effect is more remarkable when a print is made from a color negative film.

While the invention has been described in detail and with reference to specific embodiments thereof, it will be apparent to one skilled in the art that various changes and modifications can be made therein without departing from the spirit and scope thereof.

What is claimed is:

1. A color image formation method comprising developing a photographed silver halide color photographic light-sensitive material, and photoelectrically reading the image information obtained after the development processing to convert it into a digital image information, wherein the development processing is performed under the condition satisfying the following conditions (1) to (4):

(1) concentration of 2-methyl-4-[N-ethyl-N-(β-hydroxyethyl)-amino]aniline sulfate in the color developer is from 0.02 to 0.2 mol/l;

(2) the bromide ion concentration in the color developer is from 0.02 to 0.05 mol/l;

(3) the color development time is from 50 seconds to 1 minute and 30 seconds; and (4) the color development temperature is from 45 to 50° C., wherein said photographed silver iodobromide color photographic light-sensitive material is a color negative film comprising a support having provided thereon at least one light-sensitive layer comprising a silver iodobromide emulsion having a silver iodide content of from 2 to 10 mol %, and wherein the image is read by a line CCD-scanning method.

2. The color image formation method as claimed in claim 1, wherein said color developing agent concentration in the color developer is from 0.025 to 0.1 mol/l.

3. The color image formation method as claimed in claim 1, wherein said method further comprises taking out the digital image information to a printer.

* * * * *